US010597834B2

(12) United States Patent
Koestner

(10) Patent No.: US 10,597,834 B2
(45) Date of Patent: Mar. 24, 2020

(54) CRASH BARRIER SYSTEM WITH DIFFERENT INTERVALS

(71) Applicant: Dr. Ing. h.c. F. Porsche Aktiengesellschaft, Stuttgart (DE)

(72) Inventor: Matthias Koestner, Sachsenheim (DE)

(73) Assignee: Dr. Ing. h.c. F. Porsche Aktiengesellschaft (DE)

( * ) Notice: Subject to any disclaimer, the term of this patent is extended or adjusted under 35 U.S.C. 154(b) by 22 days.

(21) Appl. No.: 15/269,121

(22) Filed: Sep. 19, 2016

(65) Prior Publication Data

US 2017/0081815 A1 Mar. 23, 2017

(30) Foreign Application Priority Data

Sep. 18, 2015 (DE) ..... 10 2015 115 768

(51) Int. Cl.

| | |
|---|---|
| ***E01F 15/00*** | (2006.01) |
| ***E01F 15/04*** | (2006.01) |
| ***E01F 15/14*** | (2006.01) |
| ***E01F 15/08*** | (2006.01) |

(52) U.S. Cl.

CPC ..... *E01F 15/04* (2013.01); *E01F 15/043* (2013.01); *E01F 15/0438* (2013.01); *E01F 15/0453* (2013.01); *E01F 15/0461* (2013.01); *E01F 15/0476* (2013.01); *E01F 15/081* (2013.01); *E01F 15/145* (2013.01); *E01F 15/146* (2013.01)

(58) Field of Classification Search

CPC ..... E01F 15/02; E01F 15/04; E01F 15/043
USPC ..... 256/13.1; 404/6, 9, 10
See application file for complete search history.

(56) References Cited

U.S. PATENT DOCUMENTS

| | | | | |
|---|---|---|---|---|
| 2,093,577 A * | 9/1937 | Shepherd | E01F 15/0423 | 256/13.1 |
| 2,238,523 A * | 4/1941 | Holst | E01F 15/06 | 256/13.1 |
| 3,430,923 A | 3/1969 | Giavotto | | |
| 4,406,563 A * | 9/1983 | Urlberger | E01F 15/025 | 256/13.1 |
| 4,638,979 A * | 1/1987 | Demarest | E01F 15/0438 | 248/66 |

(Continued)

FOREIGN PATENT DOCUMENTS

| | | |
|---|---|---|
| AT | 409004 | 5/2002 |
| DE | 1904538 | 11/1964 |

(Continued)

OTHER PUBLICATIONS

German Search Report for German Application No. 10 2015 115 768.3, dated Jul. 11, 2016 with partial translation, 8 pages.

*Primary Examiner* — Thomas B Will
*Assistant Examiner* — Katherine J Chu
(74) *Attorney, Agent, or Firm* — RatnerPrestia

(57) ABSTRACT

A crash barrier system includes upper posts, box beams, upper tube profiles and barrier rails. The box beams are connected to the upper posts on a front side of the crash barrier system. The upper tube profiles are connected to the box beams. The barrier rails are fastened to the upper tube profiles. The upper posts are arranged axially parallel to one another at a uniform axial post spacing along the box beams. The upper tube profiles are arranged axially parallel to one another at a uniform axial tube spacing along the box beams. The post spacing differs from the tube spacing.

10 Claims, 30 Drawing Sheets

(56) References Cited

U.S. PATENT DOCUMENTS 4,662,611 A * 5/1987 Ruane ..... E01F 15/0423 256/13.1
5,069,576 A * 12/1991 Pomero ..... E01F 15/0423 256/13.1
5,657,966 A * 8/1997 Cicinnati ..... E01F 15/0438 256/13.1
5,876,020 A * 3/1999 Giavotto ..... E01F 15/0423 256/1
5,957,435 A * 9/1999 Bronstad ..... E01F 15/143 256/13.1
6,488,268 B1 * 12/2002 Albritton ..... E01F 15/0461 256/13.1
6,520,711 B2 * 2/2003 Kim ..... E01F 15/0492 256/13.1
6,942,263 B2 * 9/2005 Welch ..... E01F 15/148 188/377
7,257,875 B2 * 8/2007 Masinelli ..... E01F 15/0423 256/13.1
7,677,533 B2 * 3/2010 Fracasso ..... E01F 15/025 256/13.1
7,726,632 B2 * 6/2010 Amengual Pericas ..... E01F 15/043 256/13.1
7,731,159 B2 * 6/2010 Amengual Pericas ..... E01F 15/0438 256/13.1
7,794,173 B2 * 9/2010 Amengual Pericas ..... E01F 15/0438 256/13.1
7,988,133 B2 * 8/2011 Gripne ..... E01F 15/025 256/13.1
7,997,824 B2 * 8/2011 Amengual Pericas ..... E01F 15/0453 256/13.1
8,215,619 B2 * 7/2012 Leonhardt ..... E01F 15/025 256/13.1
8,282,082 B2 * 10/2012 An ..... E01F 15/025 256/13.1
8,393,822 B2 * 3/2013 Hotchkin ..... E01F 15/088 256/13.1
8,491,216 B2 * 7/2013 Dyke ..... E01F 15/146 404/10
8,517,349 B1 * 8/2013 Ross ..... E01F 15/143 256/1
2009/0003932 A1 * 1/2009 Neusch ..... E01F 13/12 404/6
2014/0103278 A1 * 4/2014 Cai ..... E01F 15/065 256/13.1
2015/0354155 A1 * 12/2015 Yun ..... E01F 15/0423 256/13.1
2016/0145819 A1 * 5/2016 Hotchkin ..... E01F 15/08 256/13.1

FOREIGN PATENT DOCUMENTS

DE 1534565 3/1970
DE 2846258 5/1980
DE 8434689 2/1985
DE 29604226 5/1996
DE 19536915 2/1997
DE 19601377 7/1997
DE 102005020917 11/2006
DE 102007033770 10/2008
DE 202007019215 3/2011
EP 0999310 A1 * 5/2000 ..... E01F 15/043
EP 1719840 A2 * 11/2006 ..... E01F 15/043
EP 2159327 A2 * 3/2010 ..... E01F 15/043
EP 2374941 A1 * 10/2011 ..... E01F 15/043
EP 2400061 A2 * 12/2011 ..... E01F 15/043
EP 2722442 4/2014
EP 2532787 B1 * 9/2015 ..... E01F 15/025
FR 2793501 A1 * 11/2000 ..... E01F 15/043
FR 2911351 A1 * 7/2008 ..... E01F 15/043
WO WO-2007036593 A1 * 4/2007 ..... E01F 15/043

* cited by examiner

CRASH BARRIER SYSTEM WITH DIFFERENT INTERVALS

CROSS-REFERENCE TO RELATED APPLICATIONS

This application claims priority to German Patent Application No. DE 10 2015 115 768.3, filed Sep. 18, 2015, which is incorporated by reference herein in its entirety.

FIELD OF THE INVENTION

The present application relates to a crash barrier system.

BACKGROUND OF THE INVENTION

In the field of vehicle safety, passive protective devices on motor vehicle test tracks, motorsport racetracks and roads are referred to all in all as protective beams, guardrails or crash barriers. A crash barrier system of the type in question serves essentially to prevent single- or multi-track vehicles from coming off the roadway or to protect regions outside the roadway from a vehicle collision.

DE 196 01 377 A1, which is incorporated by reference herein, discloses a protective beam arrangement, known as SUPER-RAIL, in particular a steel protective beam arrangement for local reinforcement of standard crash barrier constructions. Here, the protective beam arrangement has a barrier rail which is supported by stanchions and which is connected to the stanchion via a deformation element and a lower longitudinal stringer. A further upper longitudinal stringer is also provided in addition to this lower longitudinal stringer and at the end sides of which there are provided supporting profiles which run downward to a ground anchoring and which are supported on the ground anchoring embedded in the ground. The deformation element is formed by a rectilinear circular tube which is arranged substantially vertically. The lateral spacing of the stanchions lies in the range between 1.3 and 2 m.

DE 195 36 915 C2, which is incorporated by reference herein, discloses a protective beam arrangement on a central reserve dividing two roadways with two-way traffic, which arrangement comprises sectionally assembled C-shaped profile strands which are fastened on both sides approximately in the central height region and at the upper end of posts embedded in the ground at a spacing from one another in the longitudinal direction of the central reserve, and which arrangement comprises likewise sectionally joined-together W-shaped barrier rail strands which are stiffened by means of trough-like profile pieces and are spaced in the central height region from the C-shaped profile strands by tubular buffers provided in the vertical transverse planes of the posts, wherein the C-shaped profile strands, which are arranged at the upper end of the posts and coupled with the posts by predetermined breaking connections, are connected to one another via transversely directed coupling members not connected to the posts to form an absorption strip, and sliding layers which avoid steel-on-steel friction are integrated into the connections of the C-shaped profile strands to the upper ends of the posts.

DE 10 2005 020 917 A1, which is incorporated by reference herein, discloses a protective beam arrangement for roadways, in particular for use on the roadway edge, on the central reserve or for securing danger points, comprising a plurality of stanchions which are fixed to the ground and which are connected to one another by means of lower and upper longitudinal stringers extending parallel to one another, wherein deformation elements are fixed to the lower longitudinal stringer in the region of the stanchions and support a barrier rail extending parallel to the lower longitudinal stringer, and wherein the deformation elements are each formed as a rectilinear circular tube whose axis is oriented vertically.

Finally, AT 409 004 B, which is incorporated by reference herein, discloses a barrier device consisting of uprights anchored in the ground and of guardrails which are fastened to the uprights by deformable intermediate pieces, wherein the deformable intermediate pieces are fastened to the uprights via a screw connection which is released under the action of the impact of a vehicle.

DE 296 04 226 U1, DE 20 2007 019 215 U1, DE 10 2007 033 770 B3, DE 84 34 689 U1, DE 28 46 258 A1 and DE 19 04 538 U, all of which are incorporated by reference herein, relate to further crash barrier systems.

SUMMARY OF THE INVENTION

An advantage of the invention lies—by comparison with conventional installations—in the considerably more homogeneous variation of the stiffness along the crash barrier system, which is achieved by the offset according to aspects of the invention of posts and deformation tubes. The dynamic impulse acting on a vehicle during the impact of the latter is appreciably reduced in this manner. The effects triggered by the impulse in individual cases right up to a possible rollover of the vehicle can thus be diminished.

Thus, the crash barrier system can further comprise a lower fastening bracket and a post collision guard, wherein the post collision guard is fastened to the support post on the front side near the ground by means of the lowering fastening bracket. As a rule, an impacting vehicle can slide along such a post collision guard without the otherwise exposed support posts damaging the passenger safety cell.

In a further embodiment, the crash barrier system further comprises a soft suspension, a lower tube and a motorcycle underride guard. Here, the lower tube is shorter than the upper tube and is suspended on the post collision guard by means of the soft suspension, and the motorcycle underride guard is connected to the lower tube. In the event of a collision, a flexible construction such as this absorbs a considerable amount of impact energy and prevents the serious and often fatal injuries which are suffered by a fallen motorcycle rider even at low speeds as a result of underriding the barrier rails and coming into contact with the post construction.

The box beams preferably comprise a lower box beam and an upper box beam, wherein the lower box beam is arranged above the post collision guard and the upper box beam is arranged above the lower box beam. The described position of the box beams makes the crash barrier system according to aspects of the invention doubly suited to protect sports cars on the one hand and sport utility vehicles (SUVs) on the other hand. Here, mutually offset axes of the barrier rail and lower box beam can contribute to the improved elasticity and integrity of the crash barrier assembly in order to avoid sports cars otherwise threatening to underride the crash barrier system.

The crash barrier system can further comprise C-shaped rails which are connected to the support post on a rear side of the crash barrier system. Such C-shaped rails can decisively contribute to improving the post attachment to the overall system.

In an advantageous variant, the crash barrier system comprises containers which are filled with sand, water or gravel. These can be formed from brittle materials such as Styropor, textile fabrics, films or the like in such a way that they absorb energy during an impact and release the energy again on bursting.

According to an embodiment which is particularly suitable for super-elevated roadways, the crash barrier system further comprises an elongate ground anchoring which is connected to the support post at an obtuse angle at the end side, with the result that the support post is inclined with respect to the ground anchoring toward the front side.

Finally, it is conceivable for the crash barrier system to have a defined predetermined breaking point. For this purpose, the ground anchoring and the support post are preferably screwed in such a way that the predetermined breaking point is situated substantially between the ground anchoring and the support post. In the event of a vehicle collision, the support post breaks out of the ground anchoring at this point; the damage to the vehicle is thus reduced. At the same time, this measure avoids an undesired rotational impulse which can lead to the helical ascension and rollover of the vehicle.

BRIEF DESCRIPTION OF THE DRAWINGS

Exemplary embodiments of the invention are illustrated in the drawings and are described in more detail hereinbelow.

DETAILED DESCRIPTION OF THE INVENTION

Figure 1:
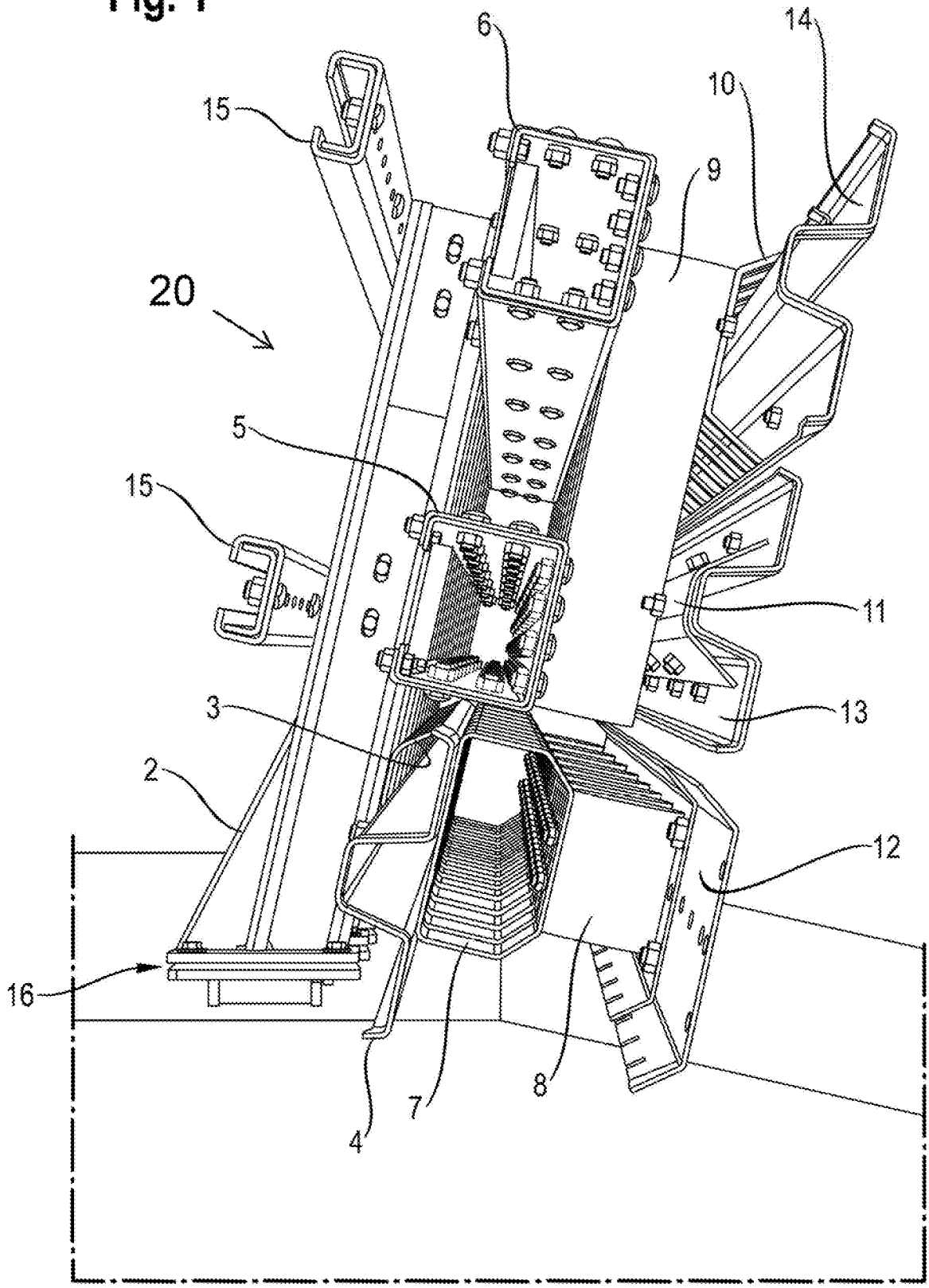
FIG. 1 shows the partial sectional view of a first embodiment.

Referring generally to the figures, a crash barrier system 20 comprises support posts 2, box beams 5, 6, upper tubes 9, lower tubes 8, barrier rails 13, 14, and a lower suspension. The support posts 2 are arranged axially parallel to one another. The box beams 5, 6 are connected to the support posts 2 on a front facing side of the support posts 2, and the box beams 5, 6 are mounted between the support posts 2 and the upper tubes 9. The upper tubes 9 are arranged axially parallel to one another, connected to the box beams 5, 6, and mounted between the barrier rails 13, 14 and the box beams 5, 6. The barrier rails 13, 14 are fastened to the upper tubes 9, and positioned on a front facing side of the crash barrier system 20. The lower suspension includes the lower tubes 8 and is fastened to the front facing side of the support posts 2 at a location beneath the box beams 5, 6 and the upper tubes 9. The lower tubes 8 are positioned at an elevation beneath the upper tubes 9, and lower tubes 8 have a greater ductility than the upper tubes 9 for absorbing impact energy in an event of a collision with the lower suspension.

Figure 2:
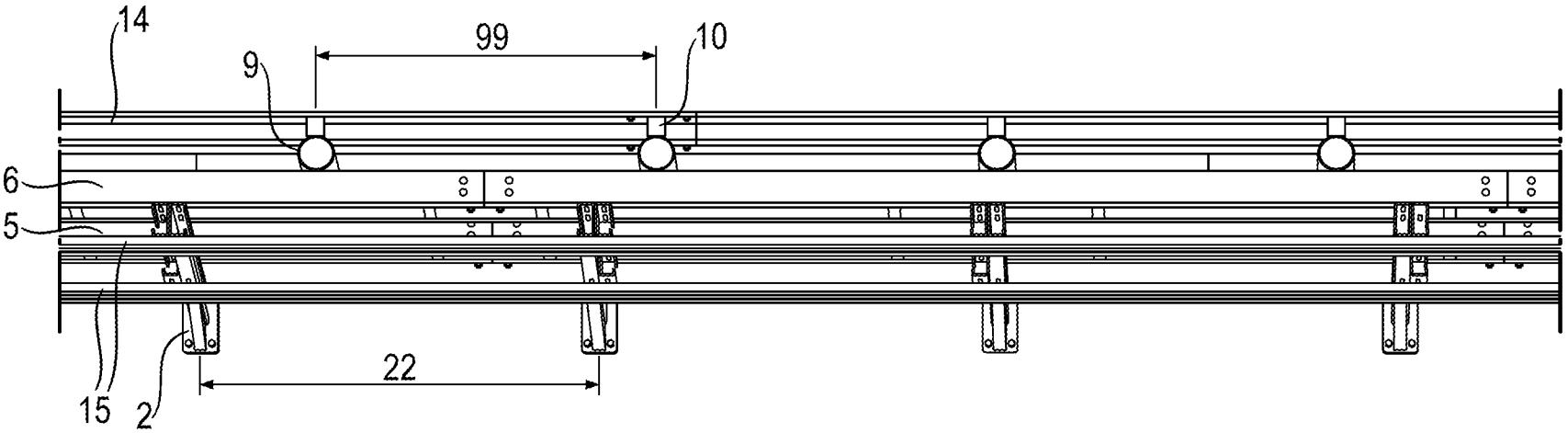
FIG. 2 shows a partial plan view of the first embodiment.
Figure 3:
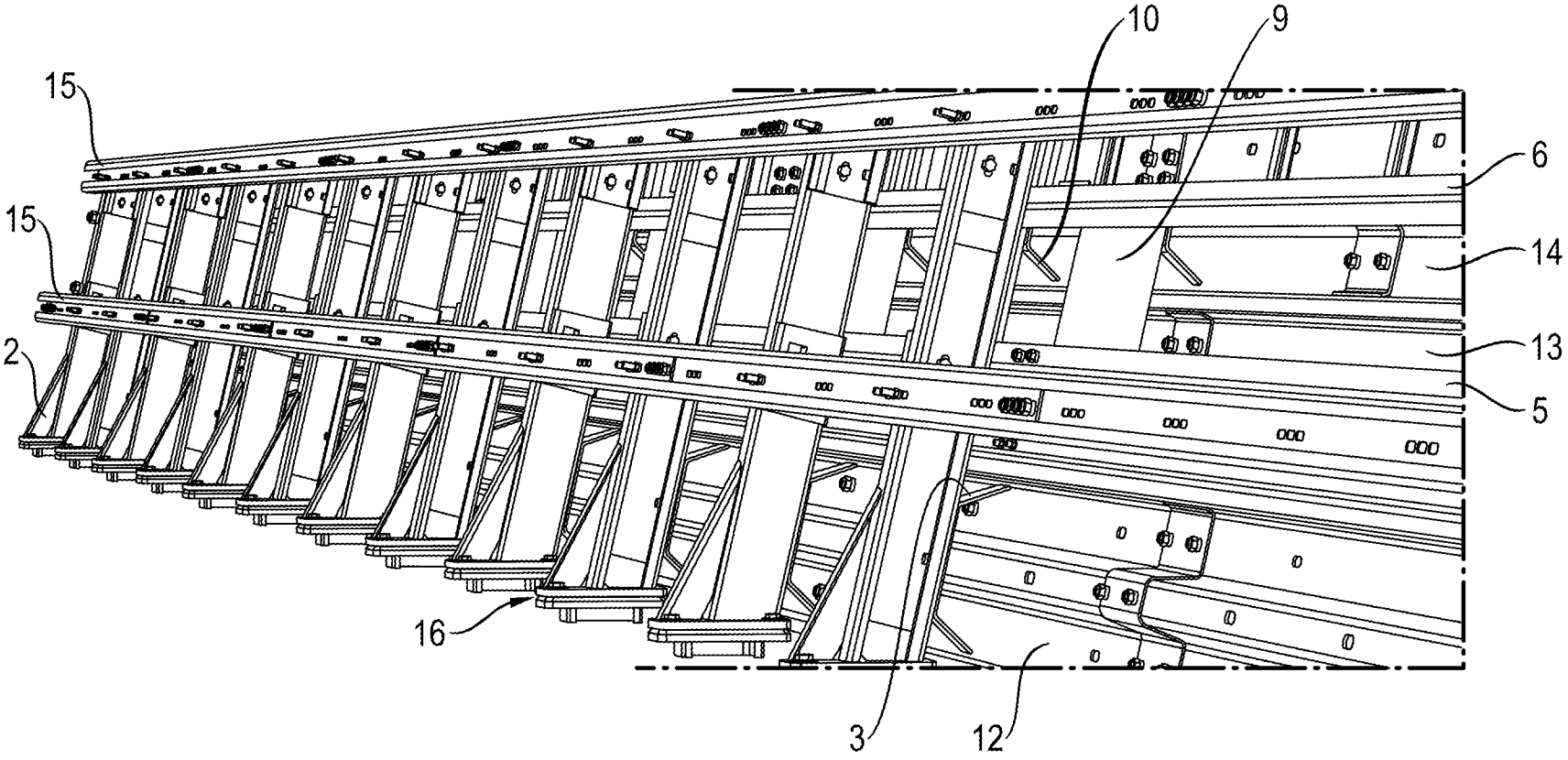
FIG. 3 shows a partial perspective view of the first embodiment.

FIGS. 1 to 3 show a crash barrier system 20 according to a first embodiment of the invention that is anchored at the edge of the super-elevated roadway of a motor vehicle test track. It will be appreciated that the crash barrier system 20 according to aspects of the invention is equally suited for flat roadways, for example for testing lane changing maneuvers. The support post 2 of the crash barrier system 20 is connected at an end side, the lower one as shown in the drawings, to a ground anchoring 1 (not fully illustrated in FIG. 1) of the crash barrier system 20 and screwed in such a way that the crash barrier system 20 has a predetermined breaking point 16 in this region. Here, the support post 2 and ground anchoring 1 are at an obtuse angle to one another in such a way that the support post 2 is inclined with respect to the ground anchoring 1 toward the right-hand side, as shown in the drawings, of the crash barrier system 20, which side will be referred to hereinbelow as its front side.

A post collision guard 4 is fastened to the support post 2 near the ground by means of a lower fastening bracket 3. A lower tube 8 is for its part suspended on this post collision guard 4 by means of a soft suspension 7, and a motorcycle underside guard 12 is connected to the lower tube 8.

A lower box beam 5 is connected to the support post 2 on the front side above the post collision guard 4, and an upper box beam 6 is in turn connected to the support post 2 on the front side above the lower box beam 5. An upper tube 9, which is longer than the lower tube 8, is for its part connected to both box beams 5, 6 and, in an alternative embodiment, can be reinforced by a possible further or additional inner tube (not illustrated in the drawing) in the upper region in order to vary or adapt the stiffness without exchanging the barrier rail.

The offset, which is essential to the invention, between the support posts 2 and tubes 8, 9 which each project upward axially parallel to one another along the box beams 5, 6 is particularly evident in the plan view shown in FIG. 2: whereas the tubes 8, 9 are uniformly connected to the box beams 5, 6 at a customary axial spacing 99 of for example 1.33 m, the axial spacing 22 between adjacent posts 2 amounts to approximately 1.6 m. It will be appreciated that, instead of this, a different value pairing 22, 99 may also be used without departing from the scope of the invention. Here, the aim of the selection is always an as irregular as possible distribution of posts 2 and tubes 8, 9 in order to reduce particularly stiff sections along the crash barrier system 20.

A lower barrier rail 13 is fastened above the motorcycle underride guard 12 to the upper tube 9 by means of a fastening beam 11, and an upper barrier rail 14 is in turn fastened above the lower barrier rail 13 to the upper tube 9 by means of an upper fastening bracket 10. Here, the box beams 5, 6 are arranged offset with respect to the barrier rails 13, 14 in order to avoid underriding of the crash barrier system 20 by sports cars, for instance.

Two C-shaped rails 15 are connected to the support post 2 on the left-hand side, as shown in the drawings, of the crash barrier system 20—hereinbelow: "rear side".

Figure 4:
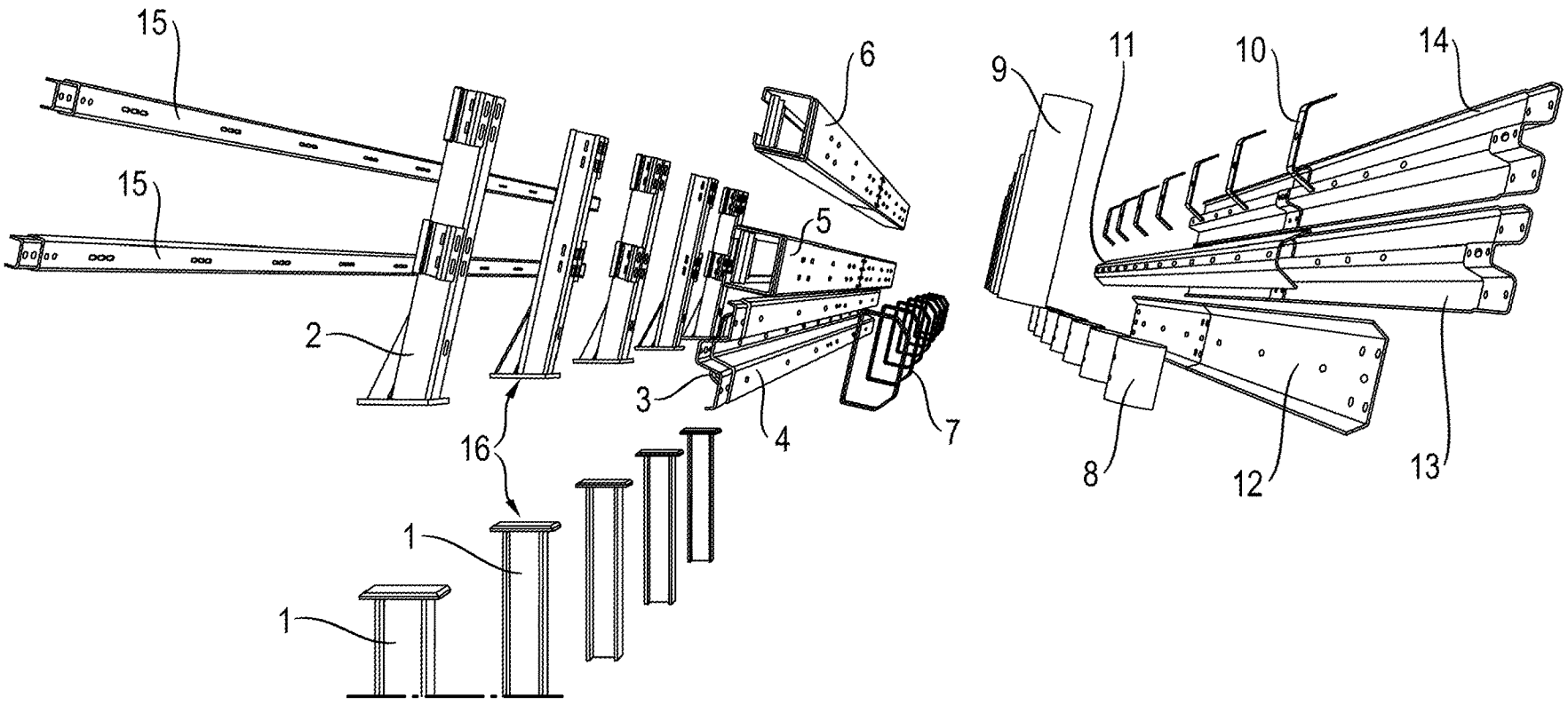
FIGS. 4-6 each show exploded illustrations of the first embodiment.
Figure 5:
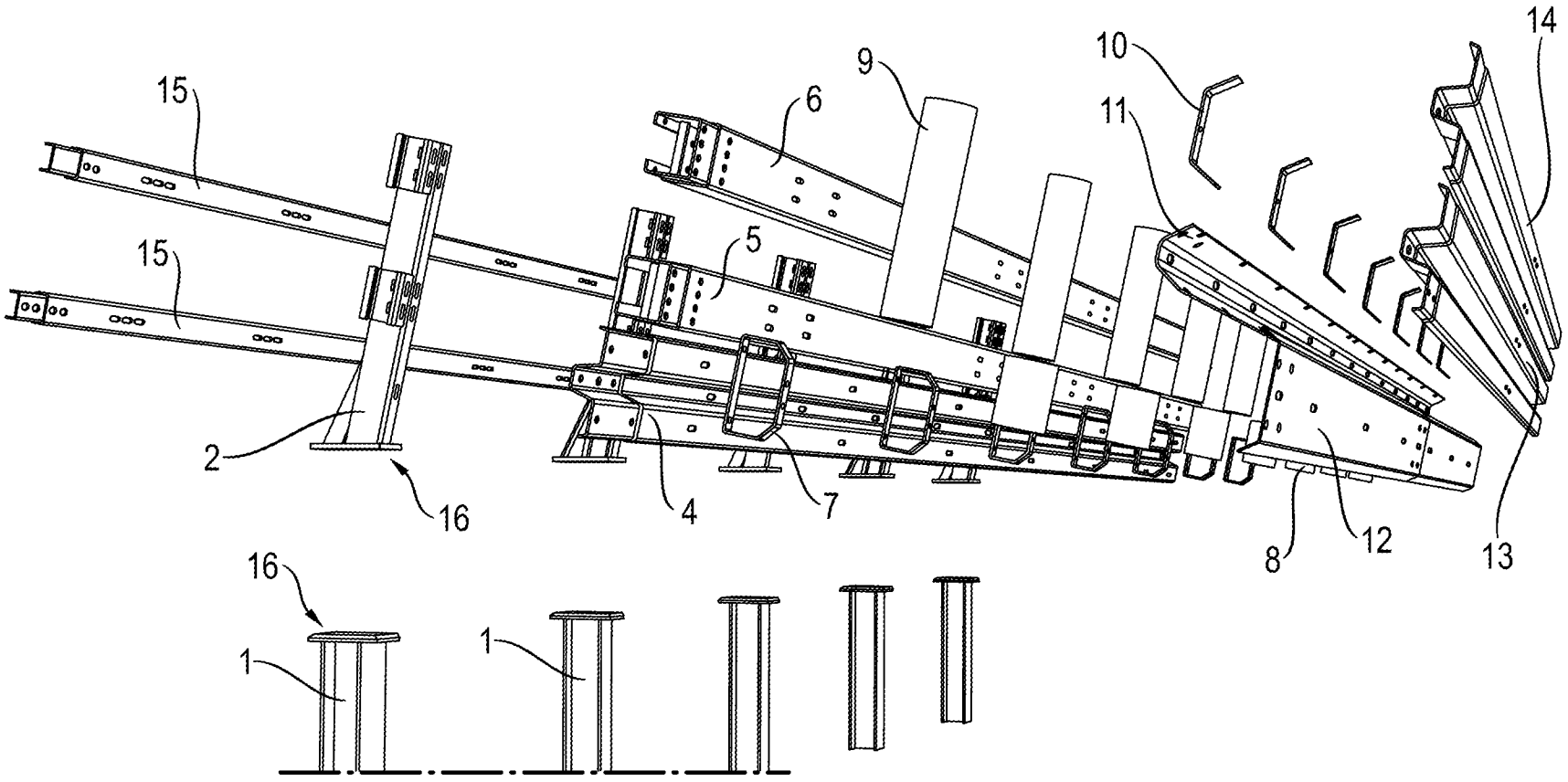
Figure 6:
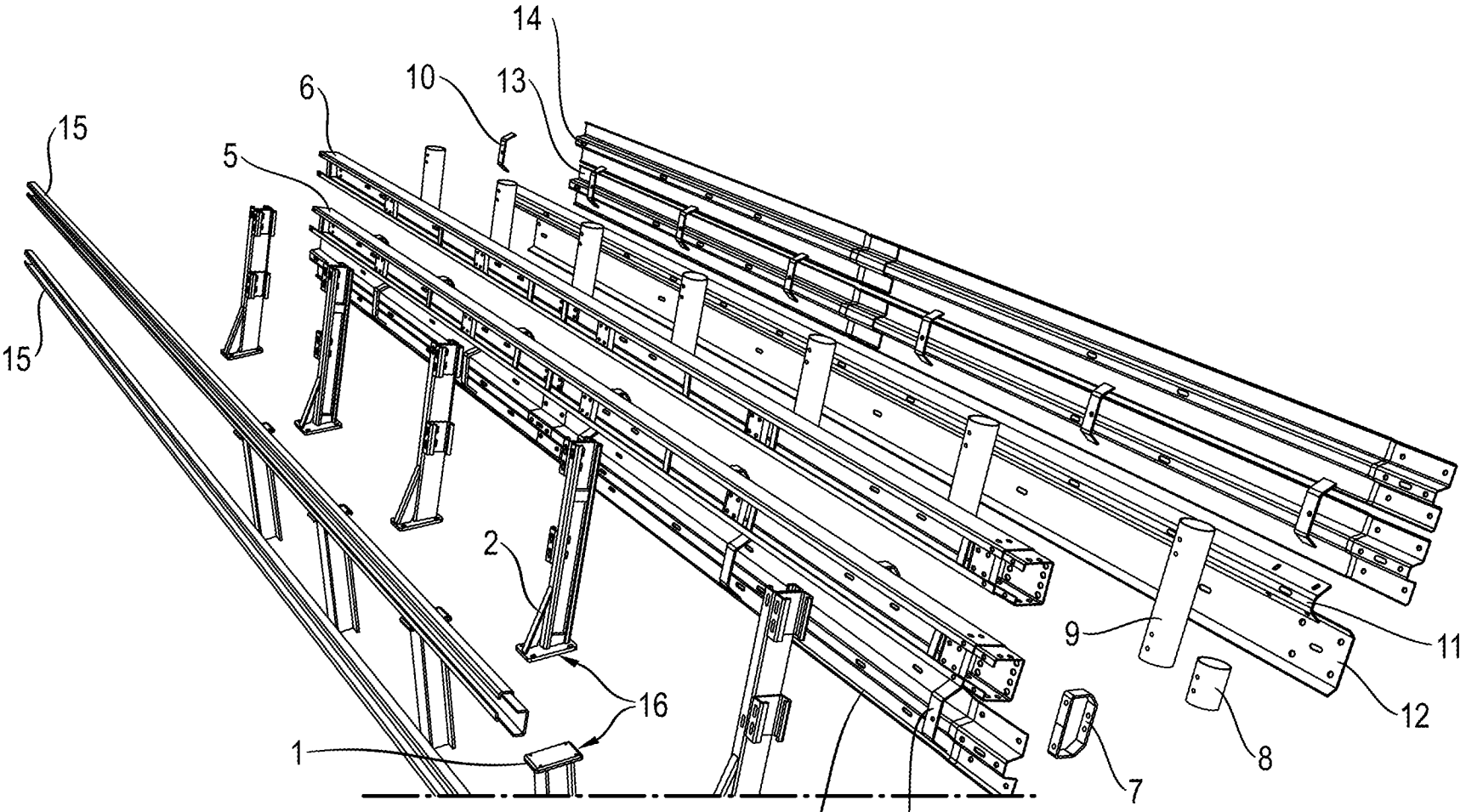

FIGS. 4 to 6 highlight the crash barrier system 20 when broken down into its individual parts. The elongate ground anchoring 1 can also be seen here.

FIGS. 7 to 21 illustrate a possible method for assembling the above-described crash barrier system 20. It will be appreciated here that the steps of the method explained in detail below can by all means be executed in a different sequence without departing from the scope of the invention. Also conceivable are the preassembly at the factory of individual subassemblies to form semifinished products, the assembly by means of a mobile assembly station or any desired combinations of the stated approaches. Furthermore, it is clear that the number of individual parts and semifinished articles used within the assembly depend substantially on the intended length of the barrier.

Figure 7:
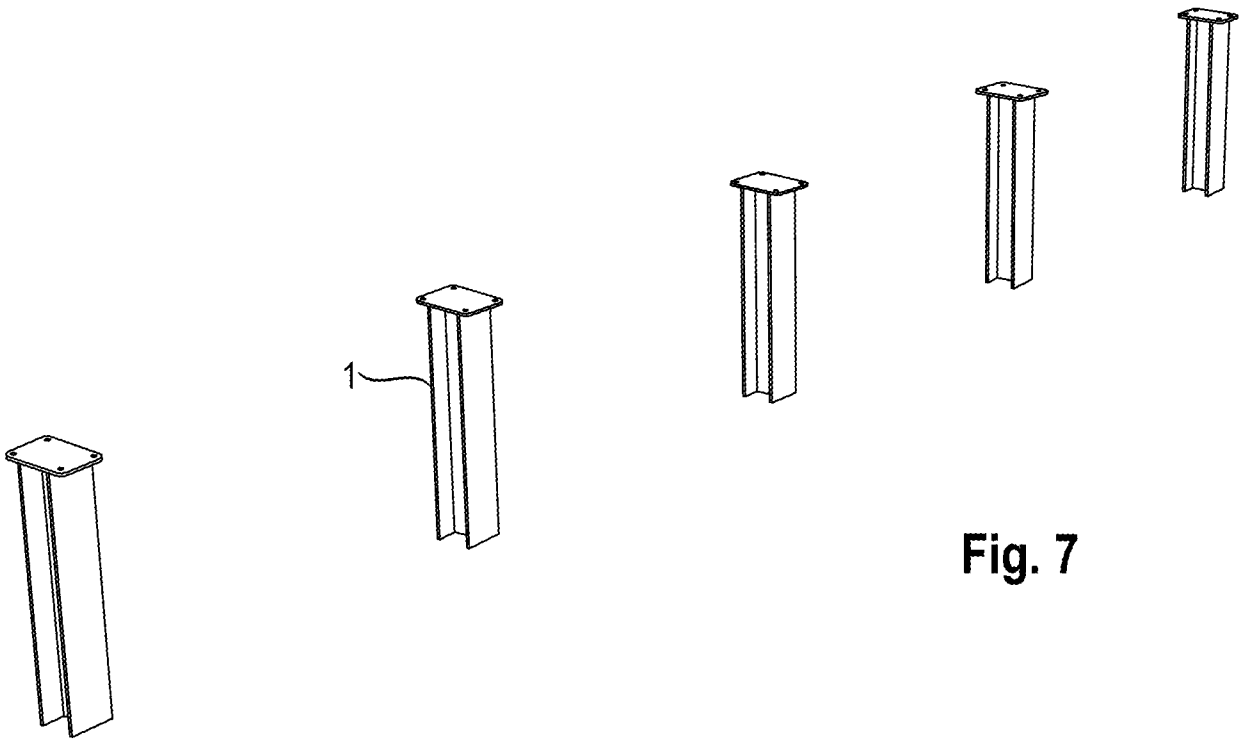
FIGS. 7-21 show mutually corresponding views of the assembly of the first embodiment in a plurality of phases.

Elongate ground anchorings 1 are first anchored axially parallel to one another at a uniform spacing at the edge of a roadway—for instance, an unused edge region of the roadway or the adjacent ground come into consideration. FIG. 7 illustrates this step, the ground itself not being part of the drawing.

Figure 8:
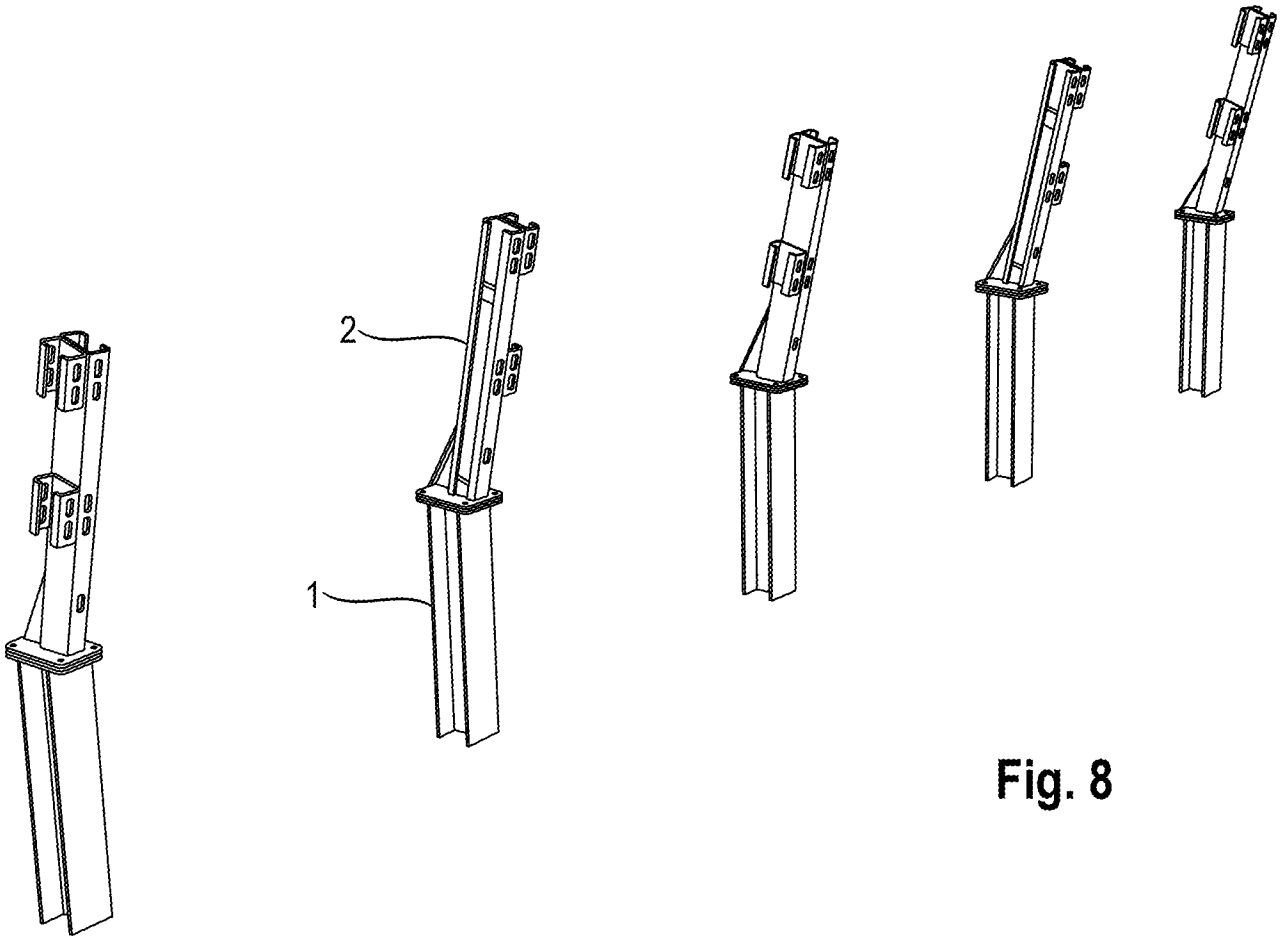

An support post 2 is then connected at an obtuse angle at the end side to each ground anchoring 1, with the result that the support post 2 is inclined with respect to the ground anchoring 1—as shown in FIG. 8—toward a front side of the crash barrier system 20.

Figure 9:
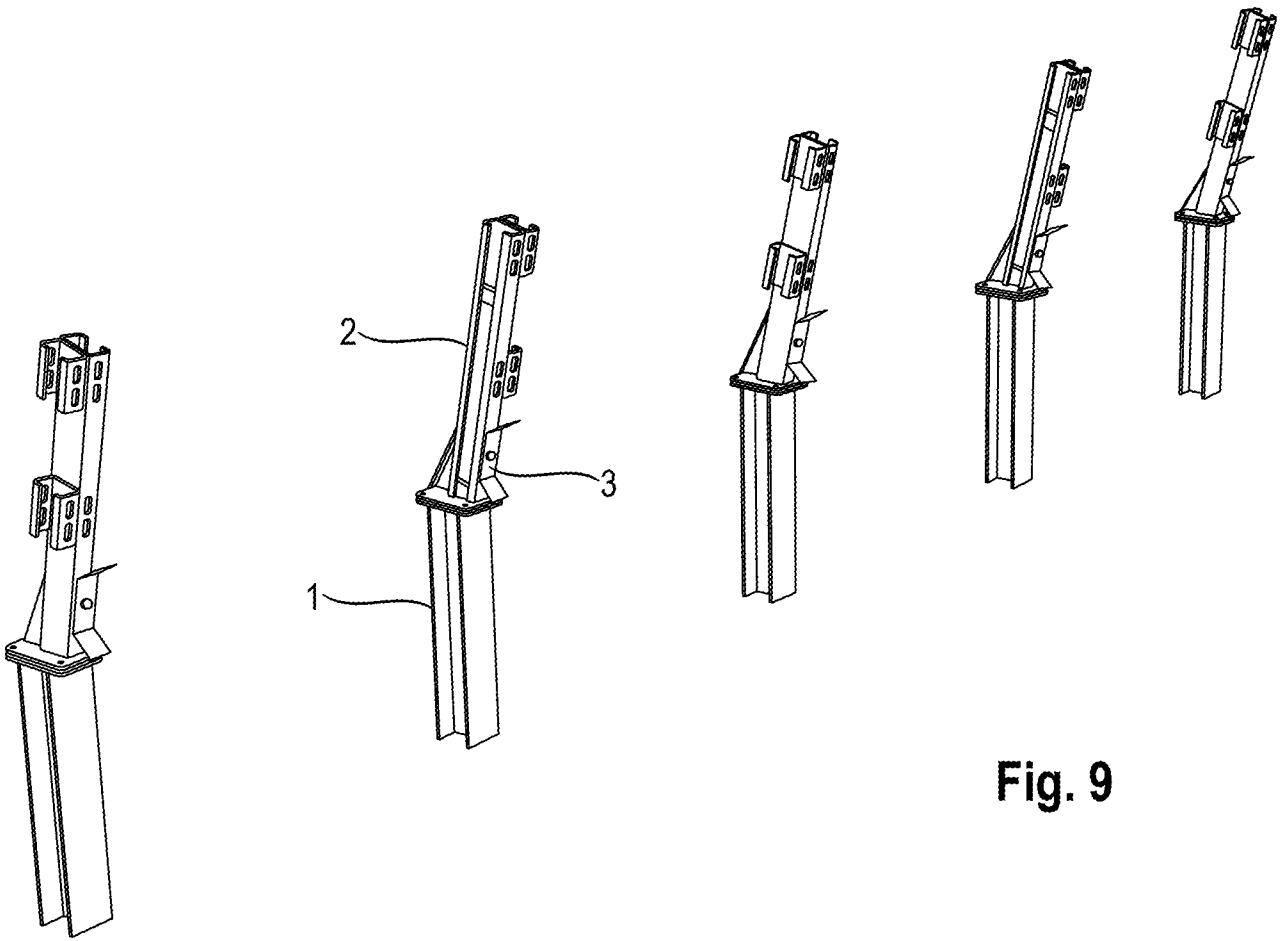

A lower fastening bracket 3 is now fastened to the support post 2 near the ground on the front side. FIG. 9 shows the construction after the completion of this assembly phase.

Figure 10:
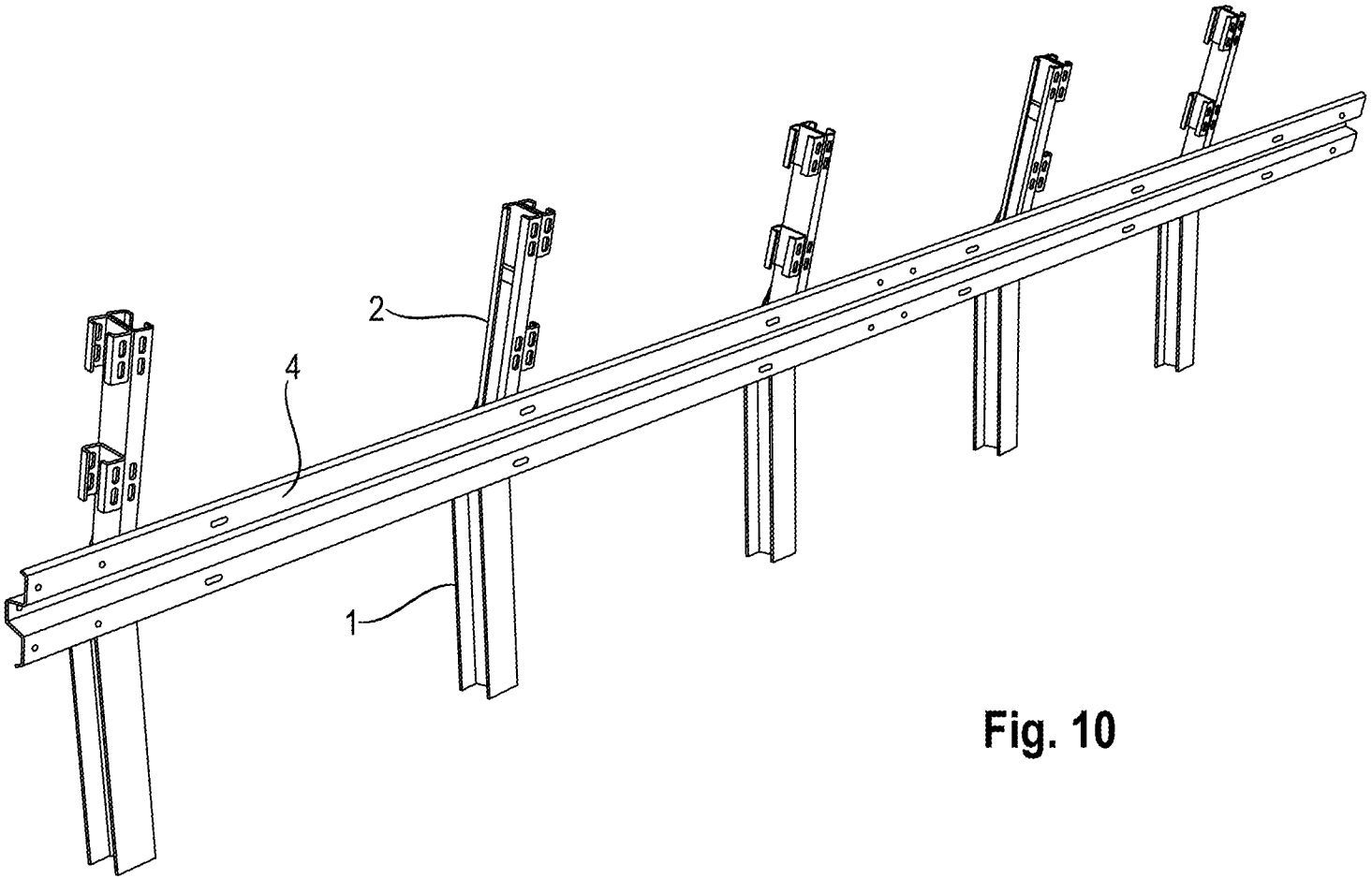

A post collision guard 4 is then fastened to the lower fastening bracket 3 (see FIG. 10).

Figure 11:
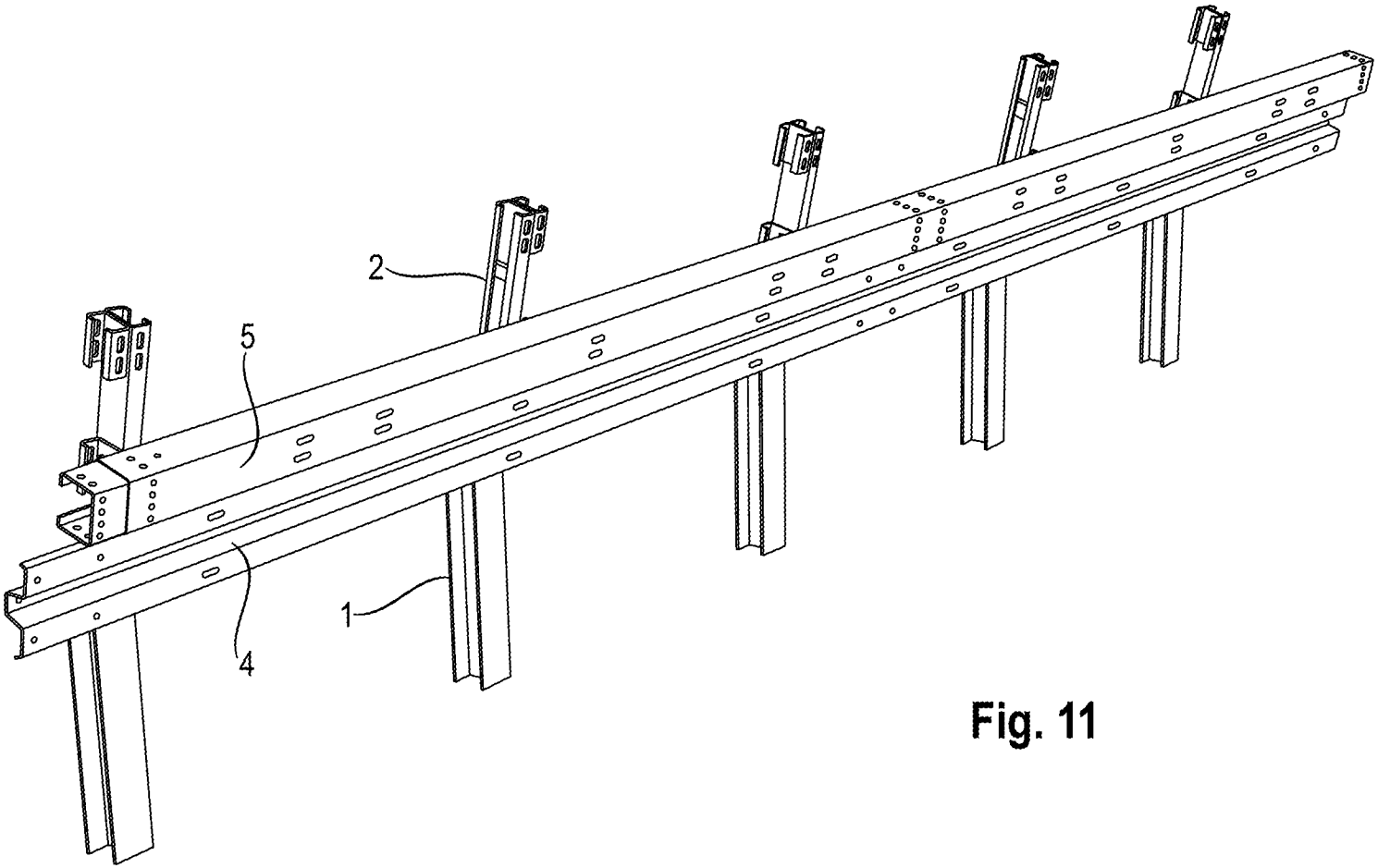

A lower box beam 5 is connected above the post collision guard 4 to the support post 2 on the front side (see FIG. 11).

Figure 12:
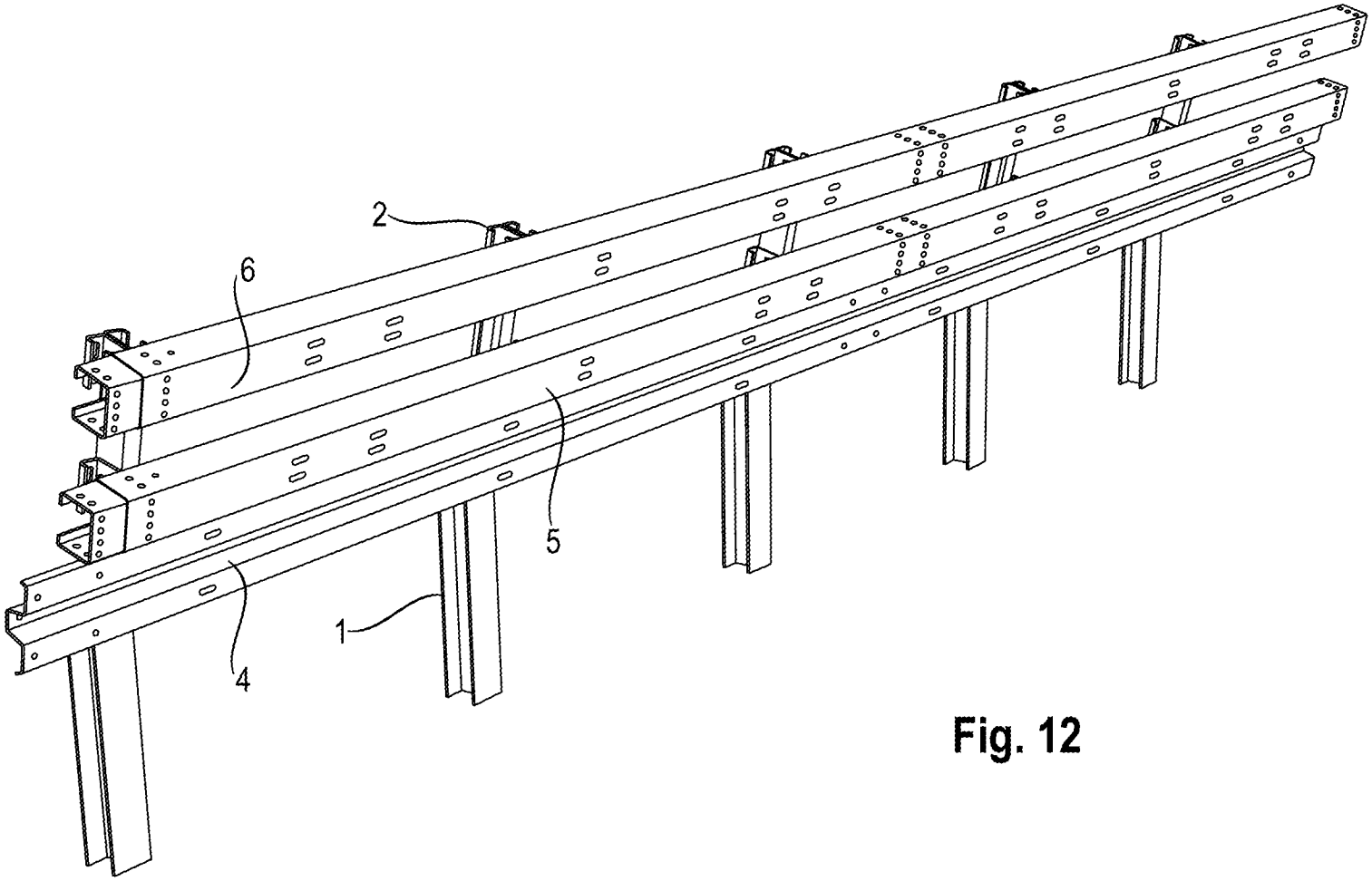

An upper box beam 6 is connected above the lower box beam 5 to the support post 2 on the front side—which, as shown in the drawings, faces the observer—(see FIG. 12).

Figure 13:
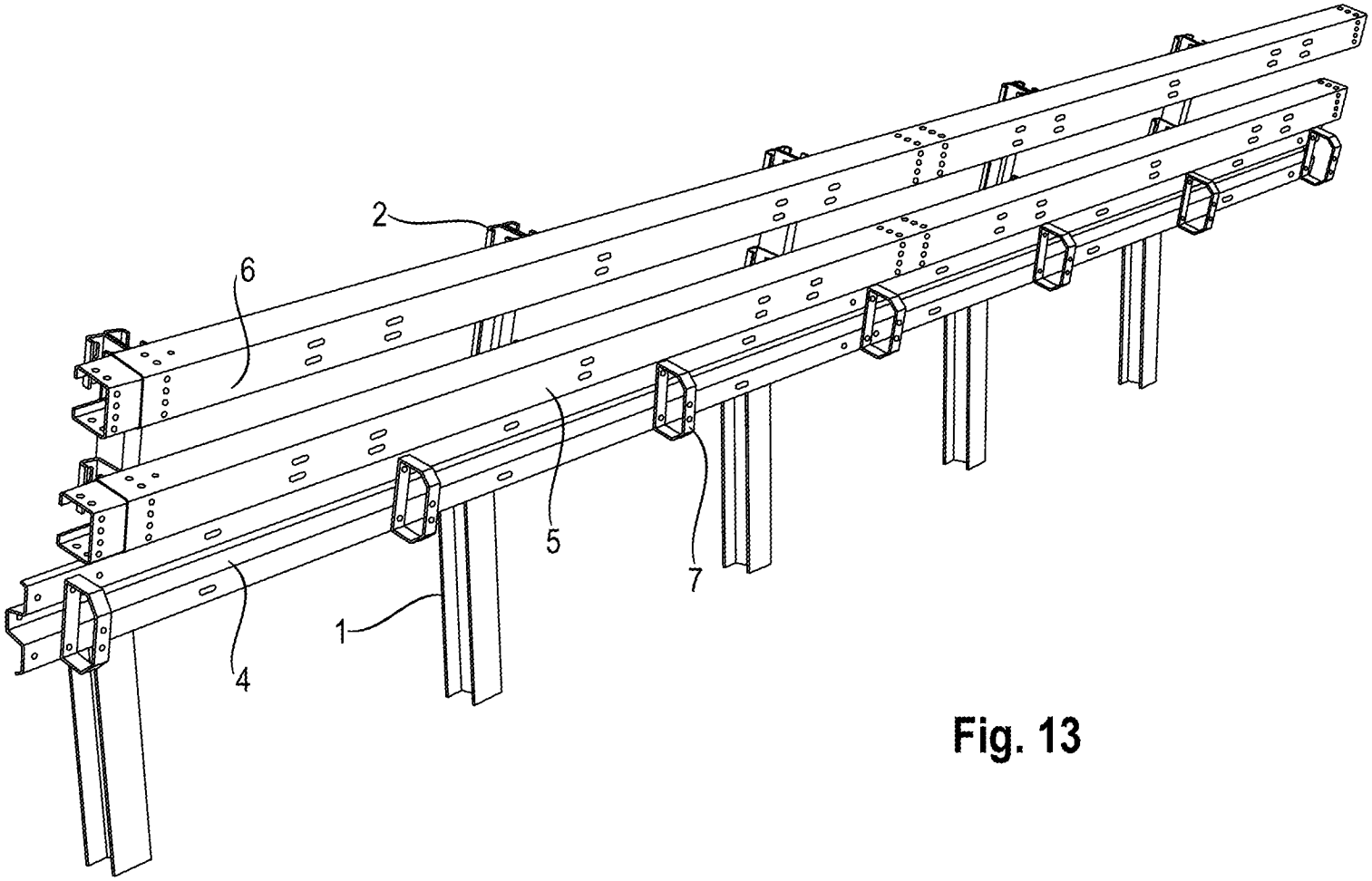

Soft suspensions 7 are suspended on the post collision guard 4 at a spacing which differs from the axial spacing of the posts 2 (see FIG. 13).

Figure 14:
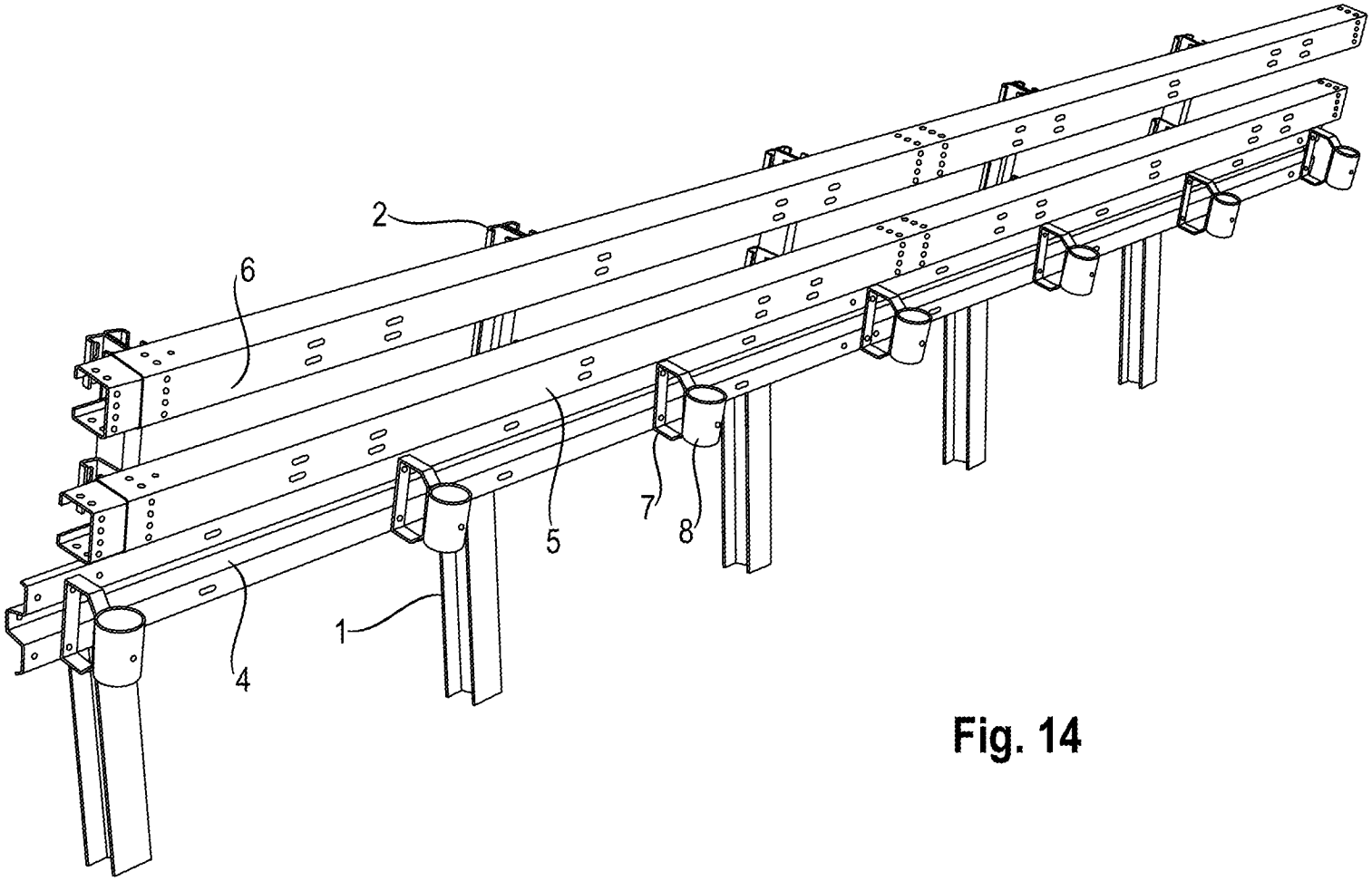

Lower tubes 8 are suspended axially parallel to one another on the soft suspensions 7 (see FIG. 14).

Figure 15:
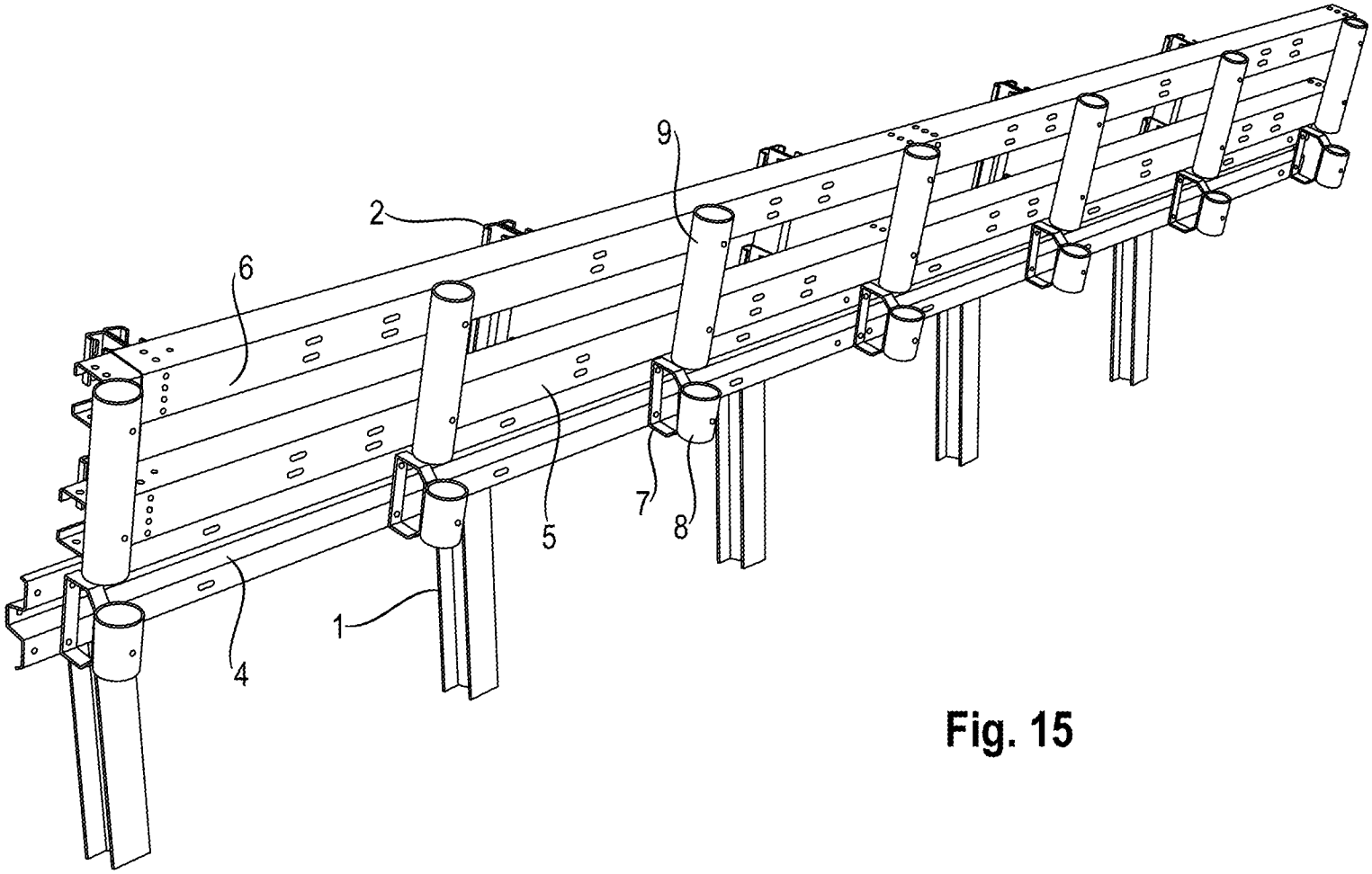

Above each lower tube 8, a longer upper tube 9 is connected to the box beams 5, 6 (see FIG. 15).

Figure 16:
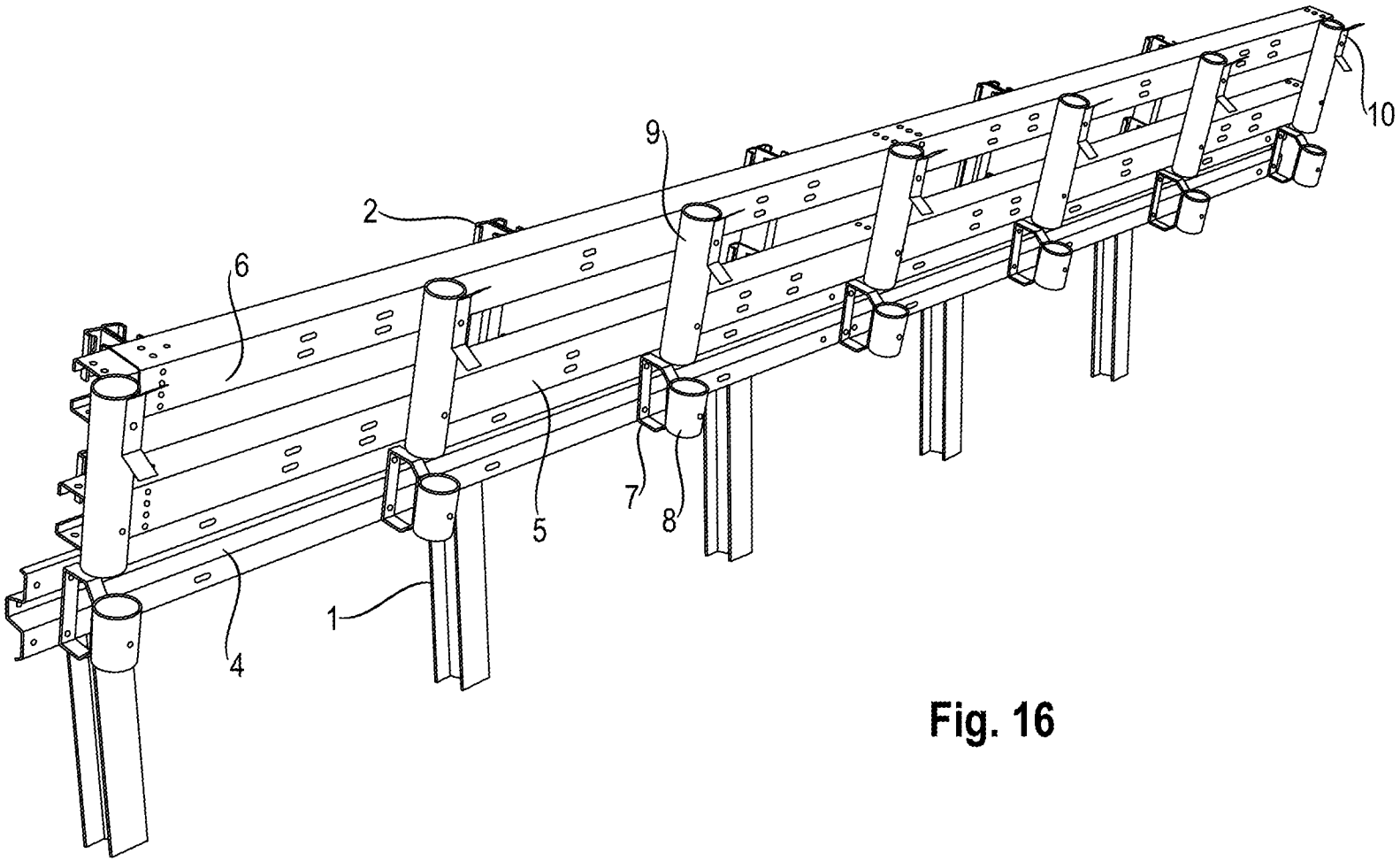

An upper fastening bracket 10 is fastened to the upper tube 9 (see FIG. 16).

Figure 17:
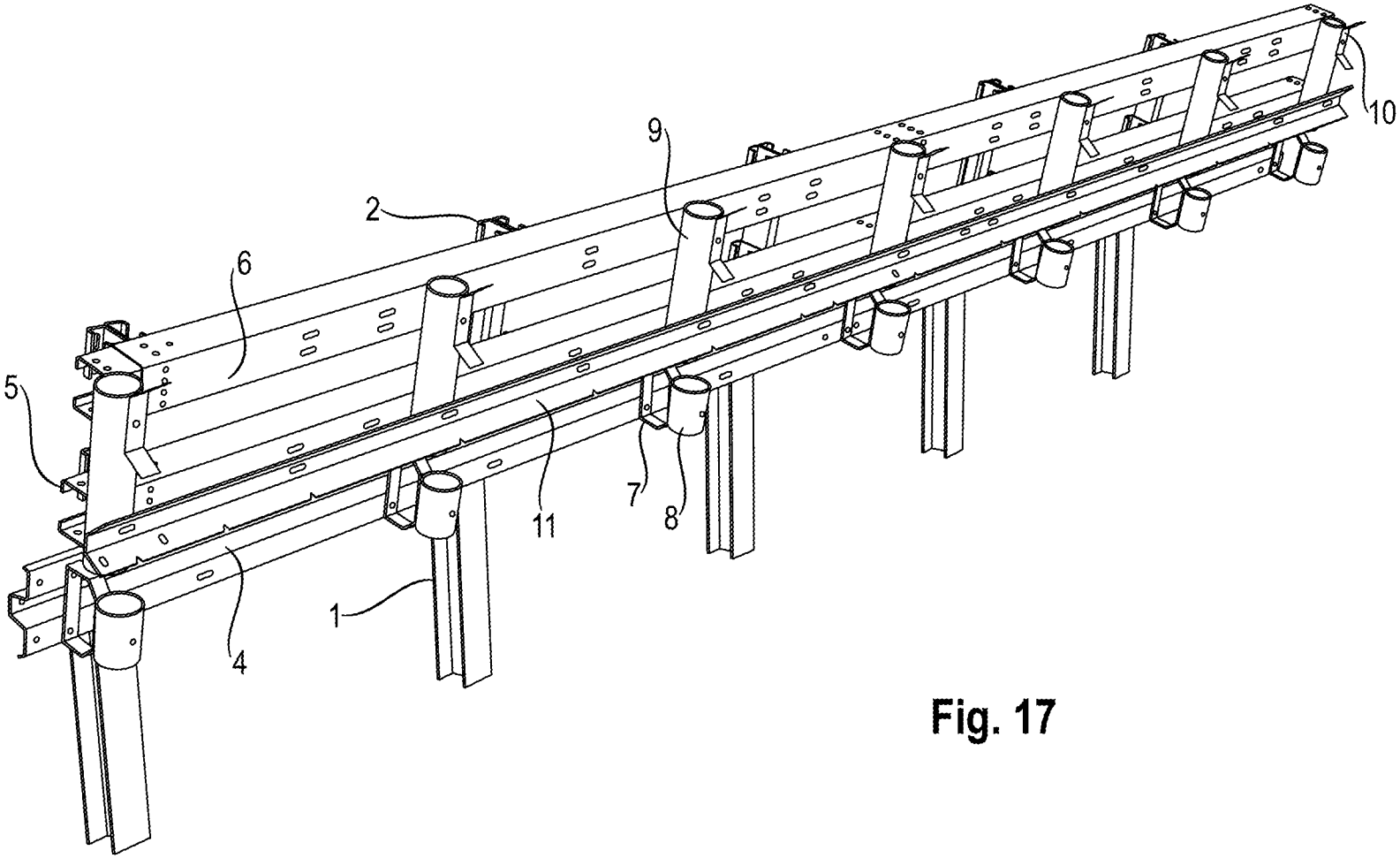

A fastening beam 11 is fastened below the upper fastening bracket 10 to the upper tube 9 (see FIG. 17).

Figure 18:
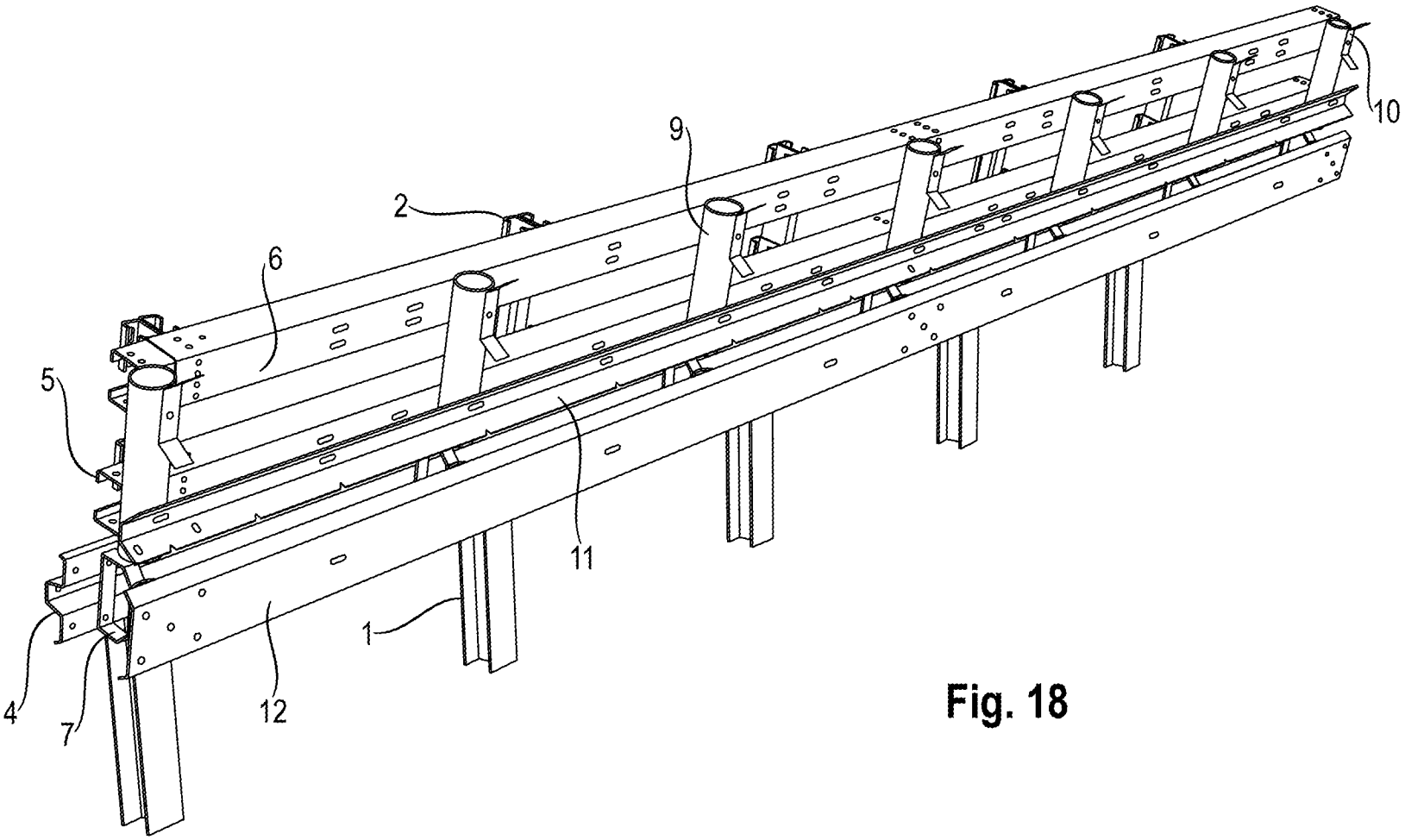

A motorcycle underride guard 12 is connected below the fastening beam 11 to the lower tube 8 (see FIG. 18).

Figure 19:
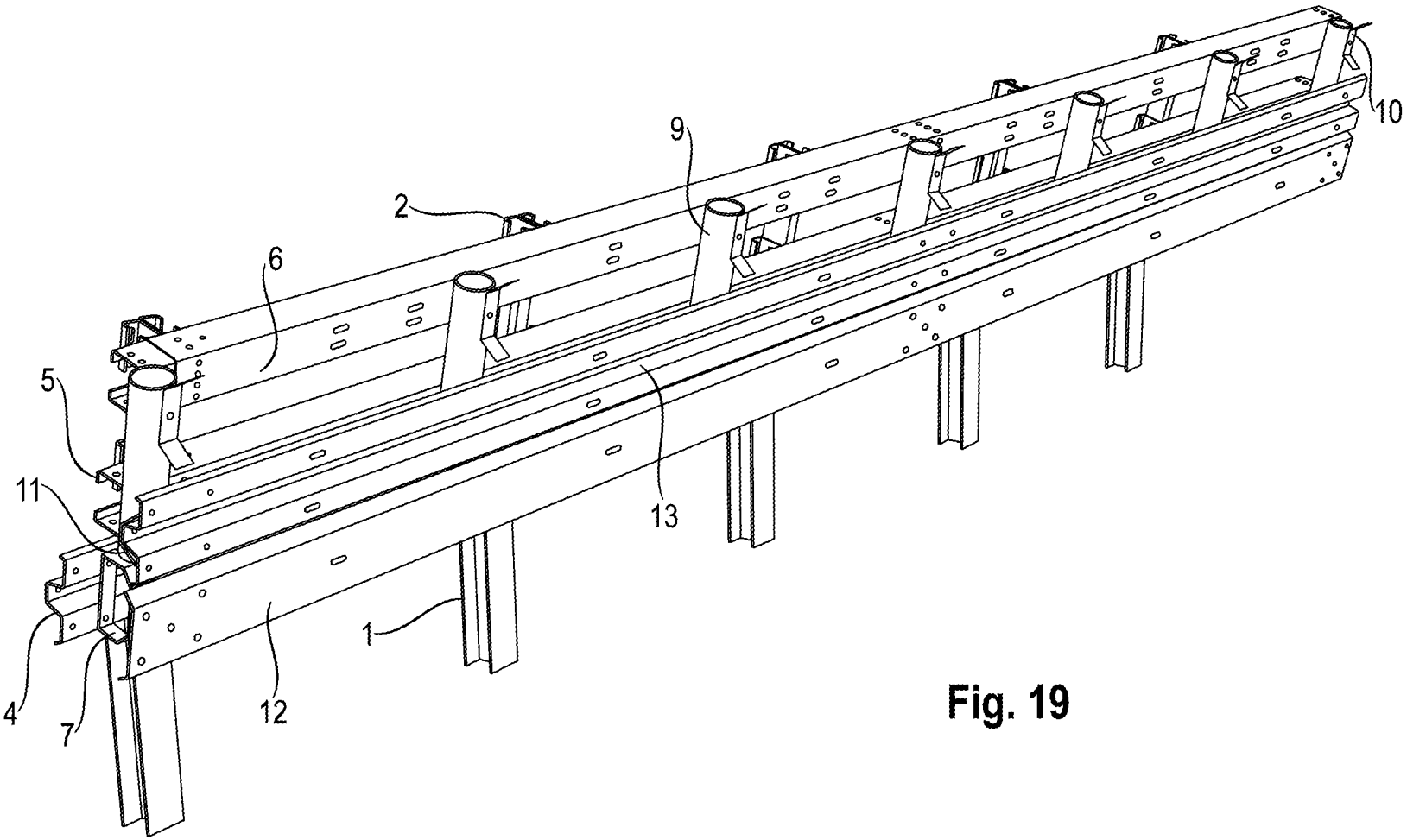

A lower barrier rail 13 is fastened to the fastening beam 11 (see FIG. 19).

Figure 20:
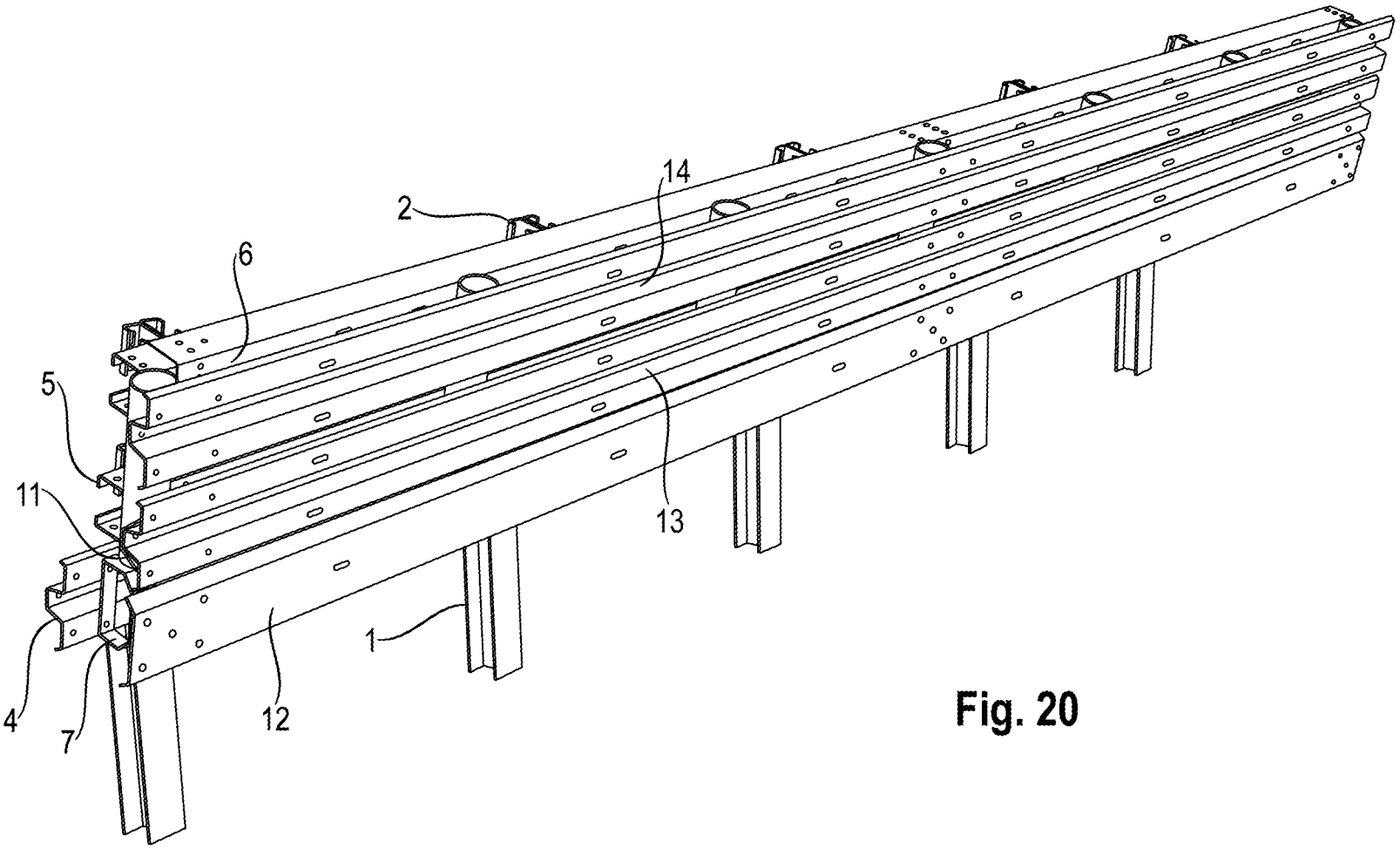

An upper barrier rail 14 is fastened to the upper fastening bracket 10 (see FIG. 20).

Figure 21:
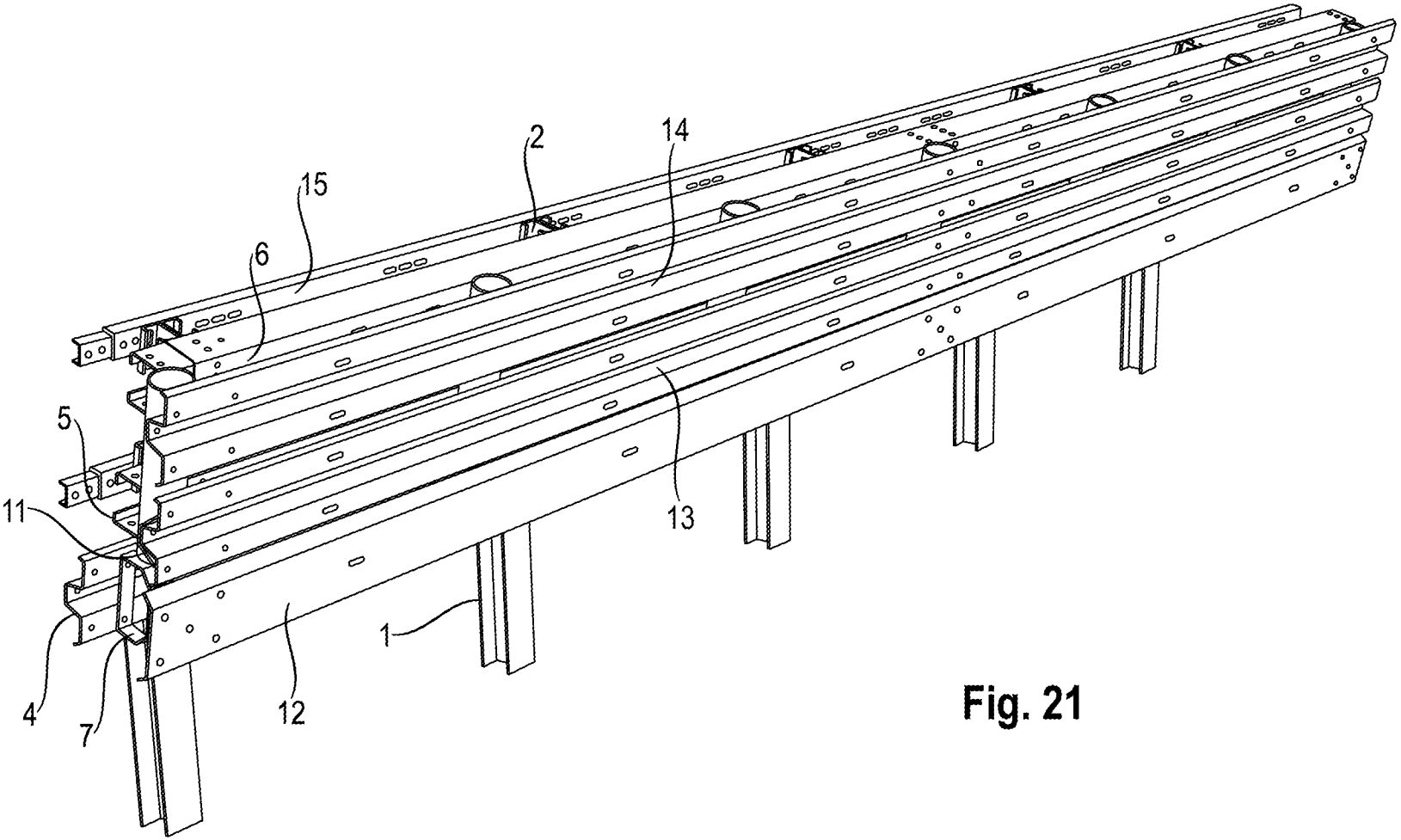
Figure 22:
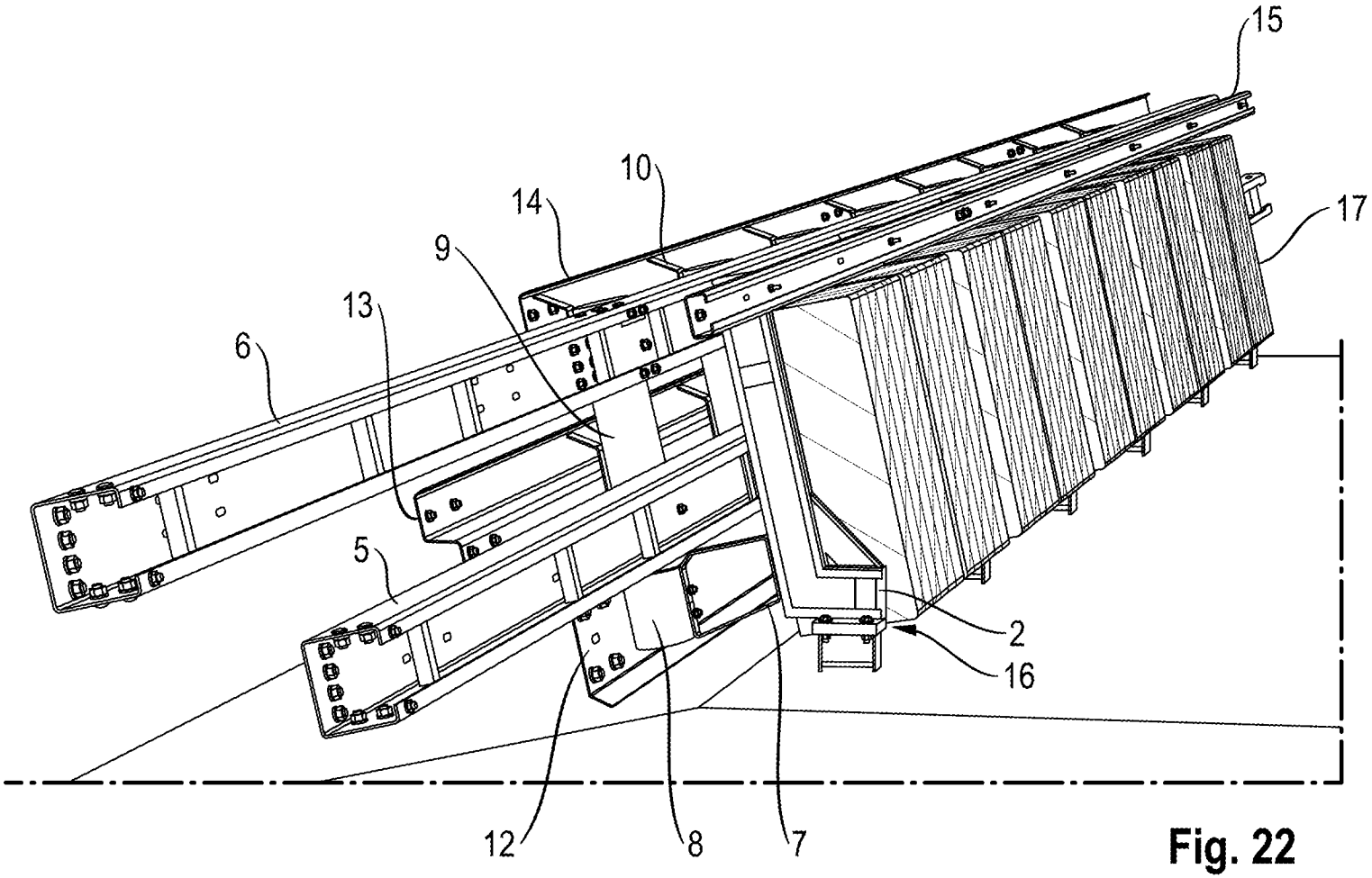
FIGS. 22 and 23 show partial perspective views of a second embodiment.
Figure 23:
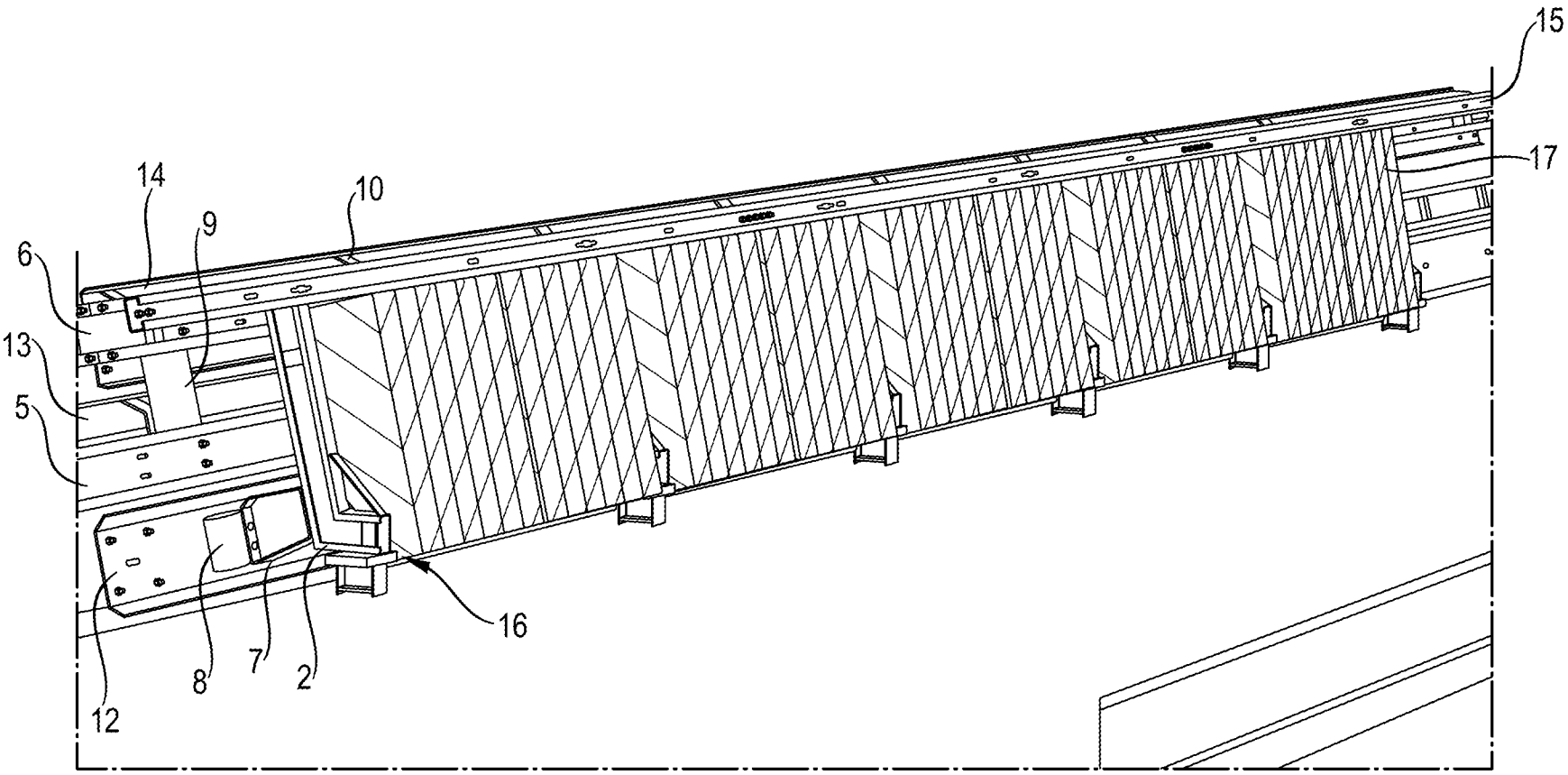
Figure 24:
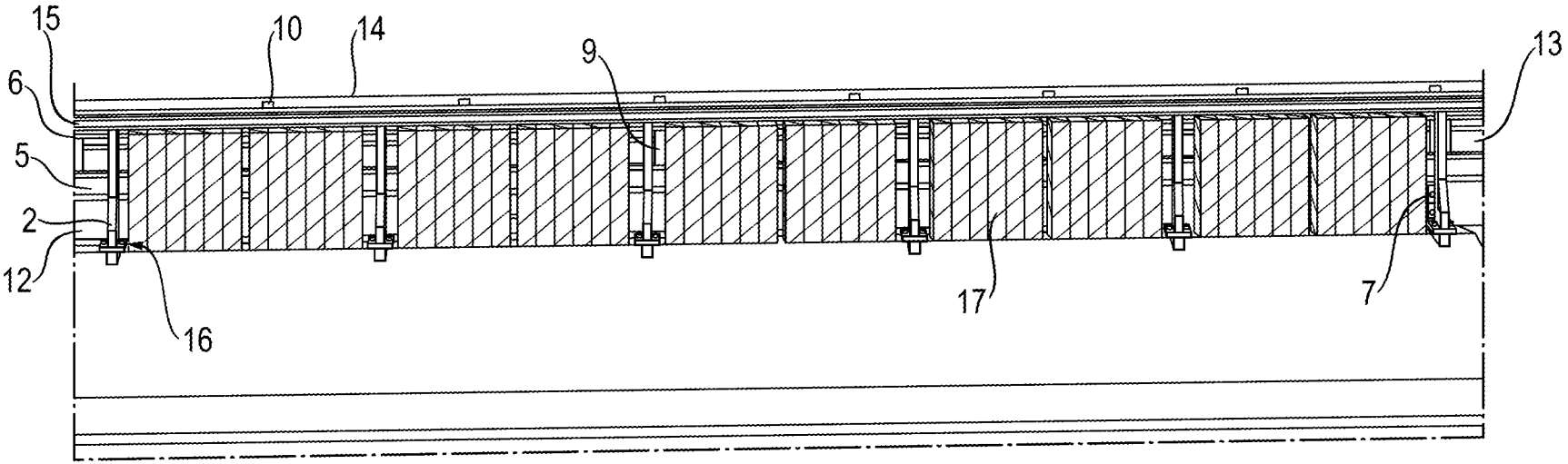
FIG. 24 shows a partial front view of the second embodiment.
Figure 25:
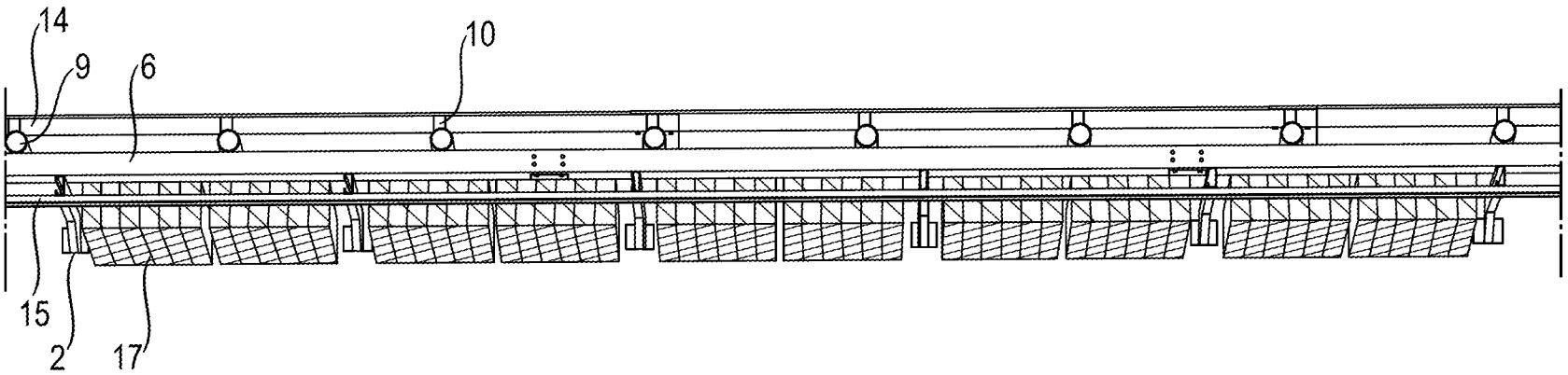
FIG. 25 shows a partial plan view of the second embodiment.

Finally, C-shaped rails 15 are connected to the support post 2 on a rear side—which, as shown in the drawings, faces away from the observer—of the crash barrier system 20. FIG. 21 shows the crash barrier system 20 in this final assembly stage.

FIGS. 22 to 25 illustrate the constructional features of a crash barrier system 20 according to a second embodiment of the invention that is anchored on a similar roadway. Here, in addition to the elements described, containers 17, which are filled with sand, water or gravel, are mounted below the C-shaped rail 15 on the rear side of the support posts 2. Said containers can be formed from brittle materials such as Styropor, textile fabrics, films or the like in such a way that they absorb energy during an impact and release the energy again on bursting.

Figure 26:
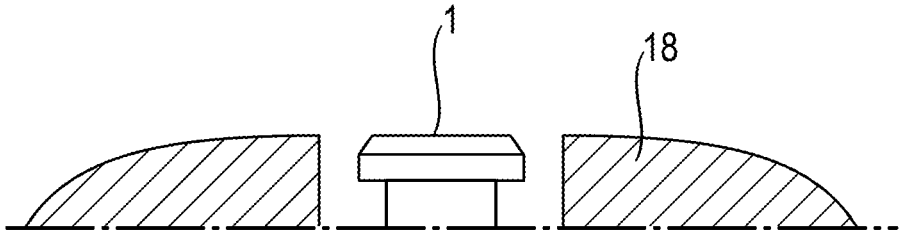
FIG. 26 shows a partial cross section of a third embodiment.
Figure 27:
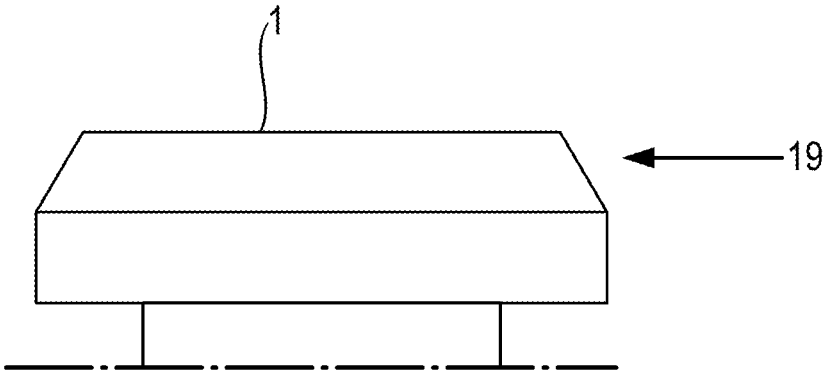
FIG. 27 shows an enlarged detail of the third embodiment.

FIG. 26 shows a preferred embodiment of the invention in which, in order to provide additional protection for impacting vehicles, the ground anchoring 1 is concealed on both sides by curbs 18 of concrete or the like known from motorsport. In order to prevent snagging of the underfloor of impacting vehicles, the ground anchoring 1 is here additionally provided with a peripheral bevel 19 along its end face, the upper one as shown in the drawings, said bevel being evident from the detail illustration of FIG. 27.

Figure 28:
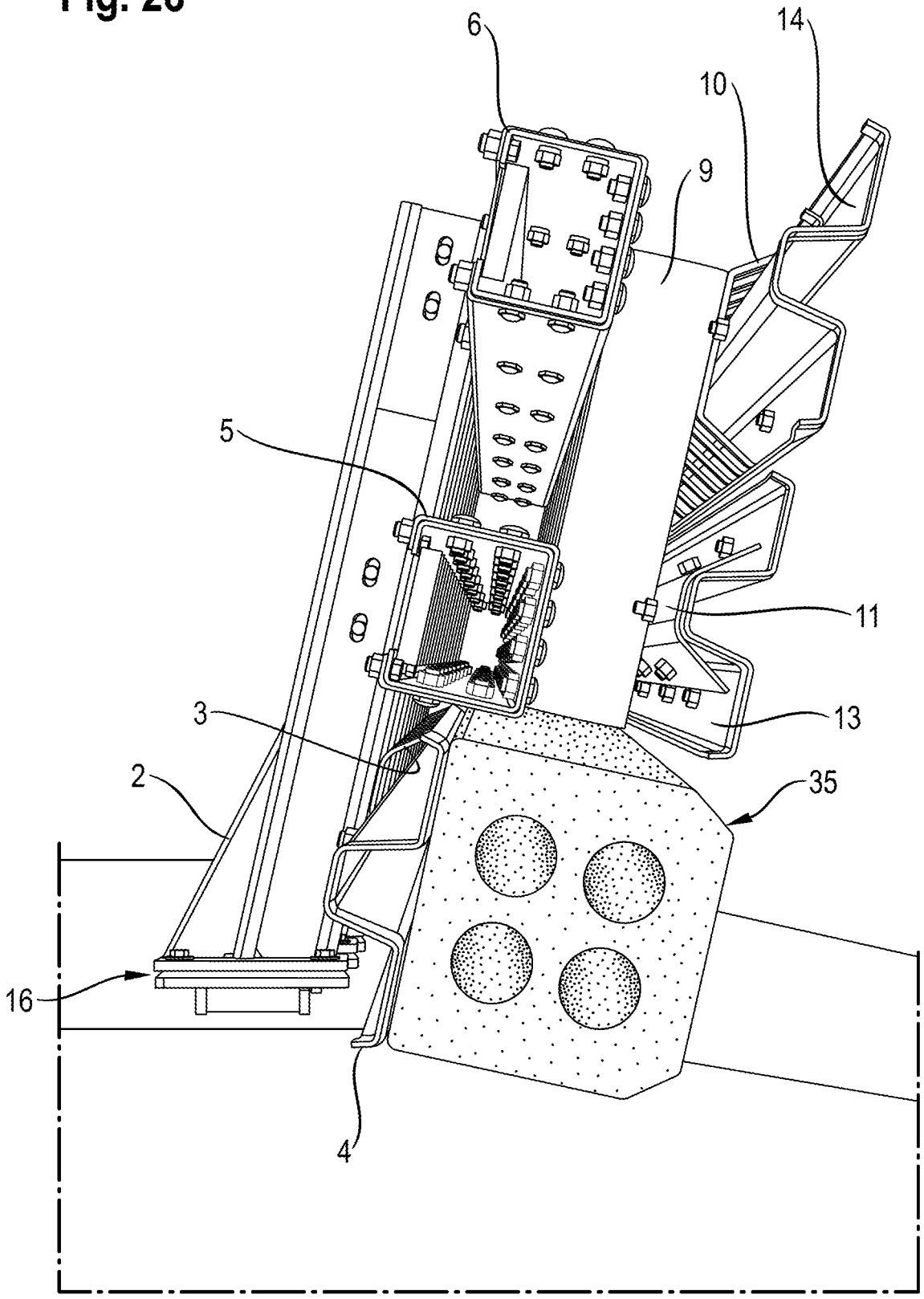
FIG. 28 shows the partial side view of a fourth embodiment.
Figure 29:
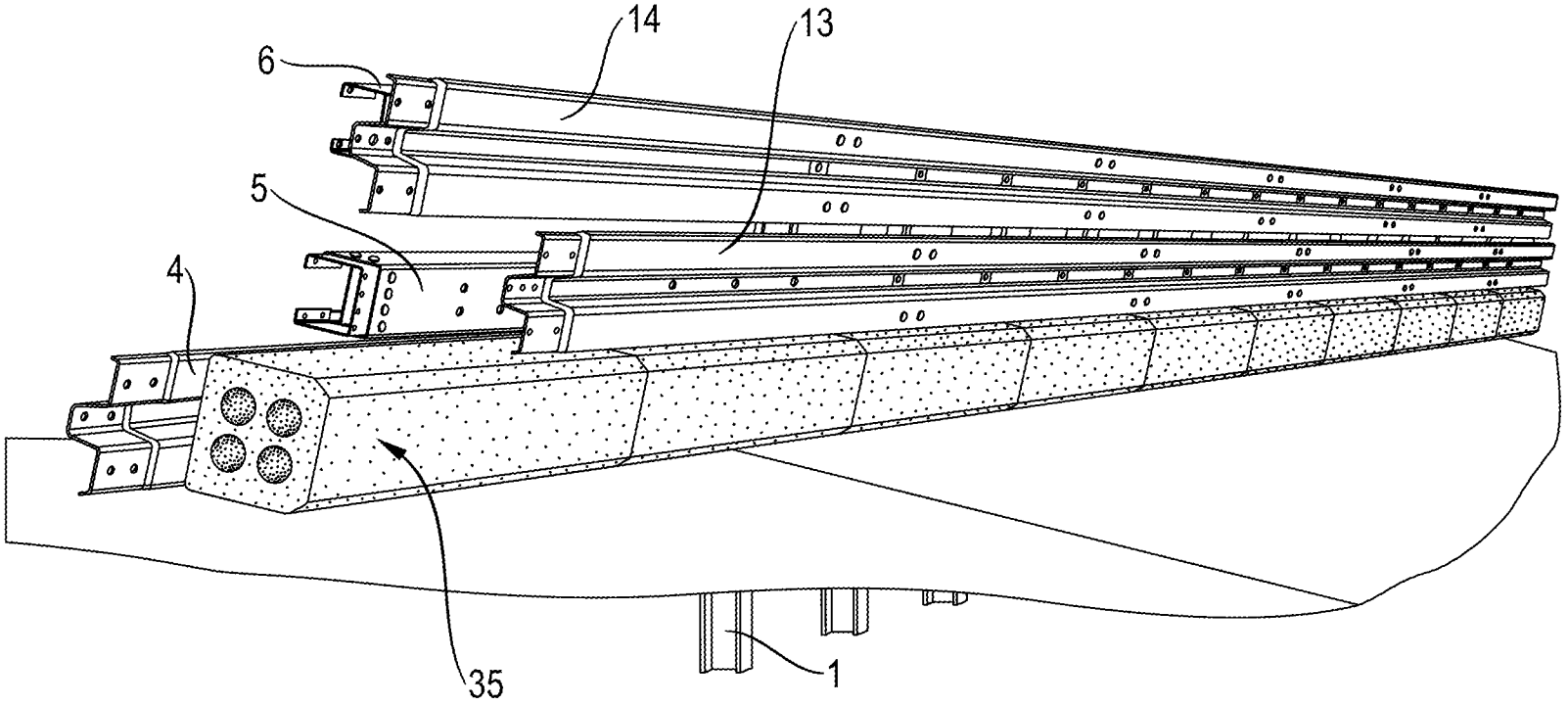
FIG. 29 shows a partial perspective view of the fourth embodiment.
Figure 30:
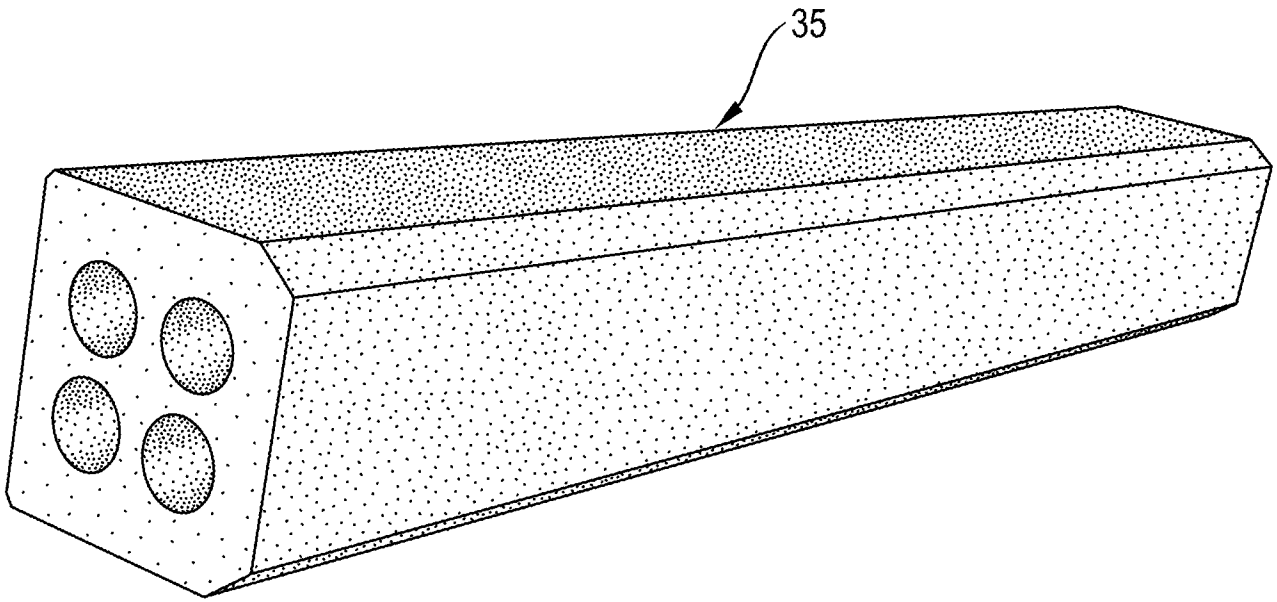
FIG. 30 shows the cross section of a foam block according to the fourth embodiment.
Figure 31:
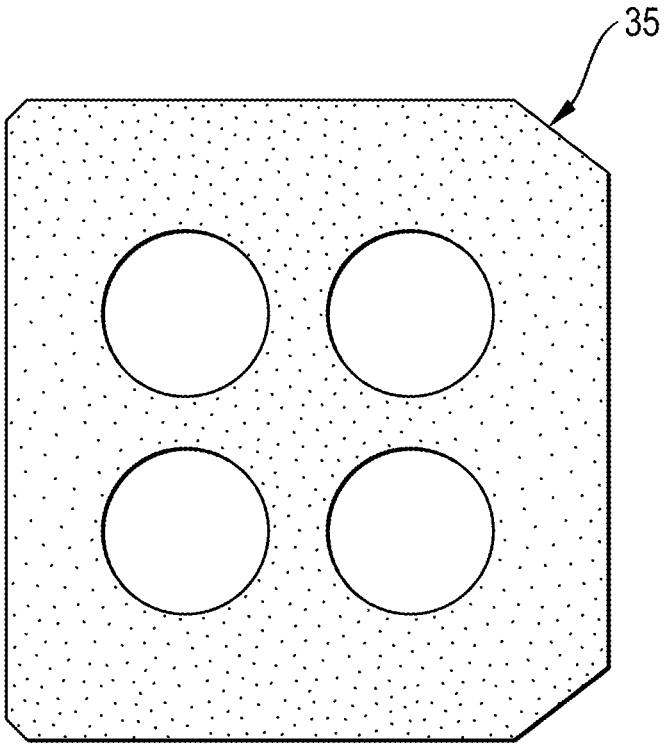
FIG. 31 shows a perspective view of the foam block.

Finally, FIGS. 28 and 29 show an alternative embodiment in two illustrations corresponding to FIGS. 1 and 2. The subassembly of the soft suspension 7—described above in relation to FIG. 13—together with the lower tube 8 supported thereby and motorcycle underride guard 12 has been replaced here for considerations of efficiency. Stepping into its place is the foam block 35 reproduced in FIGS. 30 and 31.

What is claimed is:

1. A crash barrier system comprising:

support posts, box beams, upper tubes, lower tubes, barrier rails, and a lower suspension, the support posts are arranged axially parallel to one another, the box beams are connected to the support posts on a front facing side of the support posts, and the box beams are mounted between the support posts and the upper tubes, the upper tubes are vertically oriented and arranged axially parallel to one another, connected to the box beams, and mounted between the barrier rails and the box beams, the barrier rails are fastened to the upper tubes, and positioned on a front facing side of the crash barrier system, and the lower suspension includes the lower tubes and is fastened to the front facing side of the support posts at a location beneath the box beams and the upper tubes, wherein the lower tubes are each oriented in the same vertical orientation as the upper tubes and are positioned at an elevation beneath the upper tubes, and the lower tubes are each shorter than the upper tubes and have a greater ductility than the upper tubes for absorbing impact energy in an event of a collision with the lower suspension.

2. The crash barrier system as claimed in claim 1, wherein the crash barrier system further comprises a lower fastening bracket and a post collision guard, and the post collision guard is fastened to one of the support posts on the front facing side near the ground by the lower fastening bracket.

3. The crash barrier system as claimed in claim 2, wherein the lower suspension includes the lower tubes and a motorcycle underride guard, the lower suspension is suspended on the post collision guard, and the motorcycle underride guard is connected to the lower tubes.

4. The crash barrier system as claimed in claim 3, wherein the box beams comprise a lower box beam and an upper box beam, and the lower box beam is arranged above the post collision guard and the upper box beam is arranged above the lower box beam.

5. The crash barrier system as claimed in claim 4, wherein the barrier rails comprise a lower barrier rail and an upper barrier rail, and the lower barrier rail is arranged above the motorcycle underride guard and the upper barrier rail is arranged above the lower barrier rail.

6. The crash barrier system as claimed in claim 5, wherein the crash barrier system further comprises an upper fastening bracket and a fastening beam, the lower barrier rail is fastened to the upper tube by the fastening beam, and the upper barrier rail is fastened to the upper tube by the upper fastening bracket.

7. The crash barrier system as claimed in claim 1, wherein the crash barrier system further comprises C-shaped rails, and the C-shaped rails are connected to the support post on a rear facing side of the crash barrier system that faces away from the front facing side.

8. The crash barrier system as claimed in claim 7, wherein the crash barrier system comprises containers which are filled with sand, water or gravel, and the containers are mounted on at least one of the support posts on the rear facing side at an elevation below one of the C-shaped rails.

9. The crash barrier system as claimed in claim 1, wherein the crash barrier system further comprises an elongate ground anchoring, and the support posts extend from the ground anchoring at an obtuse angle, with the result that said support posts are inclined with respect to the ground anchoring toward the front facing side of the crash barrier system.

10. The crash barrier system as claimed in claim 9, wherein the crash barrier system has a predetermined breaking point, and the ground anchoring and at least one of the support posts are fastened such that the predetermined breaking point is situated substantially between the ground anchoring and said at least one support post.

* * * * *